US008886081B2

(12) United States Patent
Yokota

(10) Patent No.: US 8,886,081 B2
(45) Date of Patent: Nov. 11, 2014

(54) ELECTROPHOTOGRAPHIC IMAGE FORMING APPARATUS WITH LIGHT BLOCKING MEMBER THAT FUNCTIONS TO GUIDE CARTRIDGE

(75) Inventor: Akinori Yokota, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 189 days.

(21) Appl. No.: 13/008,186

(22) Filed: Jan. 18, 2011

(65) Prior Publication Data

US 2012/0070185 A1 Mar. 22, 2012

(30) Foreign Application Priority Data

Sep. 22, 2010 (JP) ..... 2010-212045

(51) Int. Cl.
*G03G 15/00* (2006.01)
*G03G 21/18* (2006.01)

(52) U.S. Cl.
CPC ..... *G03G 21/1832* (2013.01)
USPC ..... 399/110; 399/111

(58) Field of Classification Search
USPC ..... 399/110, 111, 107
See application file for complete search history.

(56) References Cited

U.S. PATENT DOCUMENTS

| | | | | |
|---|---|---|---|---|
| 5,528,342 | A * | 6/1996 | Setoriyama | 399/107 |
| 7,139,507 | B2 * | 11/2006 | Sugimura et al. | 399/111 |
| 7,330,679 | B2 * | 2/2008 | Kweon | 399/111 |
| 2006/0210302 | A1 * | 9/2006 | Song | 399/111 |
| 2007/0274752 | A1 | 11/2007 | Imaizumi | |

FOREIGN PATENT DOCUMENTS

| | | | |
|---|---|---|---|
| CN | 1856744 | A | 11/2006 |
| JP | 8-305243 | | 11/1996 |
| JP | 2004224507 | | 8/2004 |
| JP | 2005031377 | A | 2/2005 |
| JP | 2007-102041 | A | 4/2007 |
| JP | 2007-176696 | A | 7/2007 |
| JP | 2009031508 | A * | 2/2009 |

OTHER PUBLICATIONS

English translation of Office Action in Korean Patent Application No. 10-2011-0017674, mailed Jun. 19, 2013.
Office Action in Korean Patent Application No. 10-2011-17674 mailed Jun. 19, 2013.
Office Action in Chinese Patent Application No. 201110044524.7, mailed Dec. 4, 2012 (with English translation).
Notice of Allowance in Korean Patent Application No. 10-2011-0017674, mailed Mar. 17, 2014.

* cited by examiner

*Primary Examiner* — Quana M Grainger
(74) *Attorney, Agent, or Firm* — Fitzpatrick, Cella, Harper & Scinto

(57) ABSTRACT

An image forming apparatus in a state that a cartridge is mounted to a mounting portion of a main assembly of the apparatus, includes a first opening, provided in the main assembly, for permitting the cartridge to pass into the main assembly to mount the cartridge; an door provided in the main assembly and movable between a closing position and an open position; a second opening, provided in the main assembly, for permitting the recording material to pass into the main assembly to supply the recording material; a light blocking member provided in the main assembly to suppress impingement of at least a part of external light having entered through the second opening onto an photosensitive drum, wherein the light blocking member functions to guide the cartridge toward the mounting portion through the first opening which is open by movement of the door to the open position.

12 Claims, 17 Drawing Sheets

(a)

(b)

ELECTROPHOTOGRAPHIC IMAGE FORMING APPARATUS WITH LIGHT BLOCKING MEMBER THAT FUNCTIONS TO GUIDE CARTRIDGE

FIELD OF THE INVENTION

The present invention relates to an electrophotographic image forming apparatus for forming an image on a recording material in the state that a cartridge is mounted to a main assembly of the apparatus.

In the present invention, the electrophotographic image forming apparatus is an apparatus for forming an image on a recording material using an electrophotographic image forming process. Examples of the electrophotographic image forming apparatus include an electrophotographic copying machine, an electrophotographic printer (a laser beam printer, a LED printer and the like), a facsimile machine and a word processor. The recording material is a material on which the image is formed through the electrophotographic image forming apparatus and includes a sheet, an OHP sheet, an envelope, a post card, label or other sheet like material.

The cartridge is a process cartridge or a developing cartridge which is demountably mountable to a main assembly an electrophotographic image forming apparatus, and is contributable to an image forming process of forming the image on a recording material. The main assembly of the apparatus is a structural portion of the electrophotographic image forming apparatus excluding the cartridge.

The process cartridge contains at least one of process means including charging means, developing means and cleaning means and contains an electrophotographic photosensitive member on which an electrostatic latent image is formed, as a unit which is detachably mountable to the main assembly of the apparatus. The process means is actable on the electrophotographic photosensitive member. Therefore, the process cartridge may be a cartridge containing as a unit the developing means as the process means and the electrophotographic photosensitive member, the unit being detachably mountable to the main assembly of the apparatus.

Here, the process cartridge containing as a unit that electrophotographic photosensitive member and the developing means is called integral type. The process cartridge containing as a unit and the electrophotographic photosensitive member and process means other than the developing means is called separate type. With the separable type, the developing means is provided in a developing unit which is separate from the process cartridge, and a process cartridge is constituted by the developing unit and a drum unit, for example. The process cartridge can be mounted to and the mounted from the main assembly by the user. Therefore, the maintenance operation for the apparatus can be performed in effect easily.

The developing cartridge includes a developing roller and accommodates a developer (toner) for developing an electrostatic latent image formed on the electrophotographic photosensitive member by the developing roller, and it is demountably mountable to the main assembly.

In the case of the developing cartridge, the electrophotographic photosensitive member is mounted to the main assembly of the apparatus or to a cartridge supporting member (so-called drawer). Or, the electrophotographic photosensitive member is provided in the separable type process cartridge, and in the case, the process cartridge does not contain developing means. The developing cartridge can be mounted and demounted relative to the main assembly of the apparatus by the user. Therefore, the maintenance operation for the apparatus can be performed in effect easily.

Therefore, the cartridge may be an integral type process cartridge and a separable type process cartridge. The separable type process cartridge and the developing cartridge may be used as a couple. In an example of the cartridge, electrophotographic photosensitive member is fixed to a main assembly of the apparatus or a cartridge supporting member, and the developing cartridge is detachably mounted so as to function on the electrophotographic photosensitive member.

In an electrophotographic image forming apparatus, a main assembly of the apparatus is provided with a feeding opening to feed the sheets into the main assembly of the apparatus from a feeding tray. In such a case, there is a liability that external disturbance light having entered the inside of the main assembly of the apparatus through the feeding opening is reflected by surfaces of sheet feeding path or the like to reach the electrophotographic photosensitive drum (drum) main assembly of the apparatus. Then, the intended latent image written on the drum or the area around the intended image changes in the potential. As a result, unintended toner may be deposited on the image area and/or the area therearound.

US2007/274752 discloses a light blocking plate for blocking the external disturbance light from entering the main assembly of the apparatus through the feeding opening. With this structure, the external disturbance light is prevented from reaching the drum.

Japanese Laid-open Patent Application Hei 8-305243 discloses an electrophotographic image forming apparatus for forming an image on a recording material in the state that the cartridge is detachably mounted to the main assembly of the apparatus. In the case of such a detachably mountable cartridge type, a guide is necessitated to guide the cartridge to a mounting position of the main assembly of the apparatus when the cartridge is mounted or demounted relative to the main assembly.

Japanese Laid-open Patent Application 2004-224507 discloses a structure in which a sheet feeding tray is projected through the opening provided at a lower portion of the main assembly of the apparatus.

The present invention provides a further improvement of such structures. It is a principal object of the present invention to provide an electrophotographic image forming apparatus provided with a function of suppressing the external light having entered the main assembly of the apparatus from impinging on a photosensitive drum and the function of guiding the cartridge in a predetermined direction into the main assembly of the apparatus. It is another object of the present invention to provide an electrophotographic image forming apparatus comprising a light blocking member for suppressing the external light having entered the main assembly of the apparatus from impinging on a photosensitive drum, the light blocking member performing the function of guiding the cartridge in the predetermined direction into the main assembly of the apparatus.

According to an aspect of the present invention, the product cost for the electrophotographic image forming apparatus can be saved. According to another aspect of the present invention, the electrophotographic image forming apparatus can be downsized. According to a further aspect of the present invention, the outer light entering the main assembly of the apparatus can be suppressed.

According to an aspect of the present invention, there is provided an electrophotographic image forming apparatus for forming an image on a recording material in a state that a cartridge is mounted to a mounting portion of a main assembly of the apparatus, said apparatus comprising a first opening, provided in said main assembly of the apparatus, for permitting said cartridge to pass into the main assembly to mount said cartridge to said mounting portion; an openable member provided in said main assembly of the apparatus and movable between a close position for closing said first opening and an open position for opening said first opening; a second opening, provided in said main assembly of the apparatus, for permitting the recording material to pass into said main assembly of the apparatus to supply the recording material; and a light blocking member provided in said main assembly of the apparatus to suppress impingement of at least a part of external light having entered said main assembly of the apparatus through said second opening onto an electrophotographic photosensitive drum, wherein said light blocking member functions to guide said cartridge toward said mounting portion when said cartridge is mounted to said mounting portion through said first opening which is open by movement of said openable member to the open position.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

Part (a) of FIG. 1 is a right-hand side view of an electrophotographic image forming apparatus according to Embodiment 1 of the present invention, and (b) is a partial enlarged view of part (a).

Figure 3A:
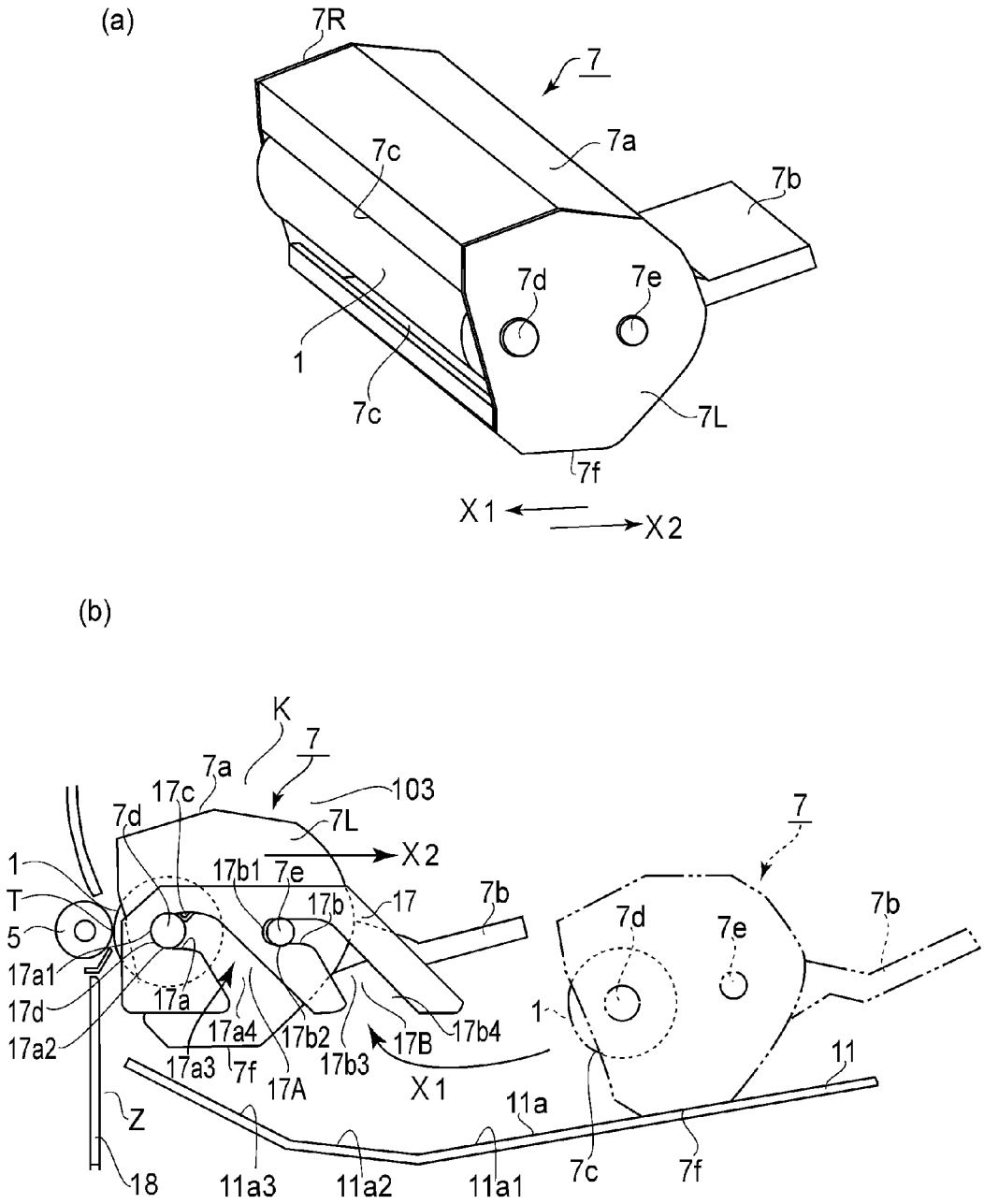

Part (a) of FIG. 3A is a perspective view of an outer appearance of the cartridge, and part (b) is an illustration of an insertion track of the cartridge.

Figure 3B:
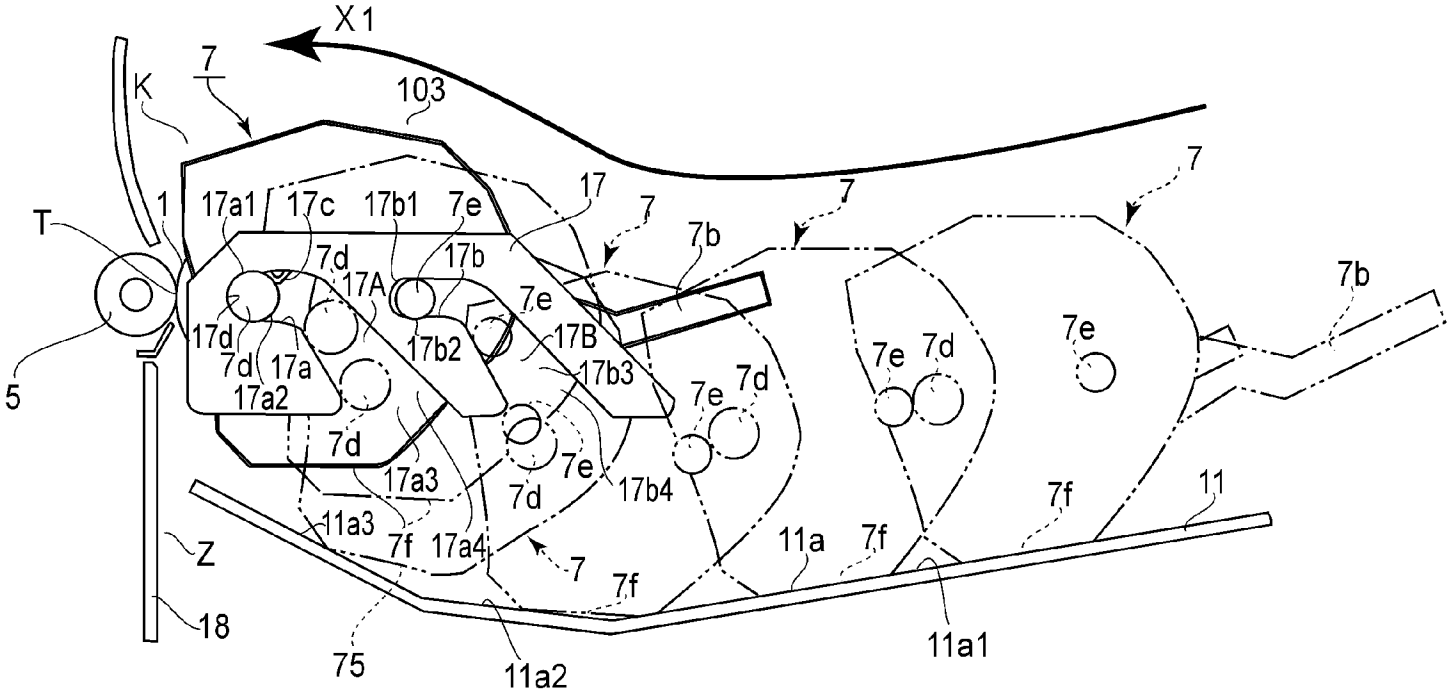

FIG. 3B is a detailed illustration of the insertion track of the cartridge.

Figure 4:
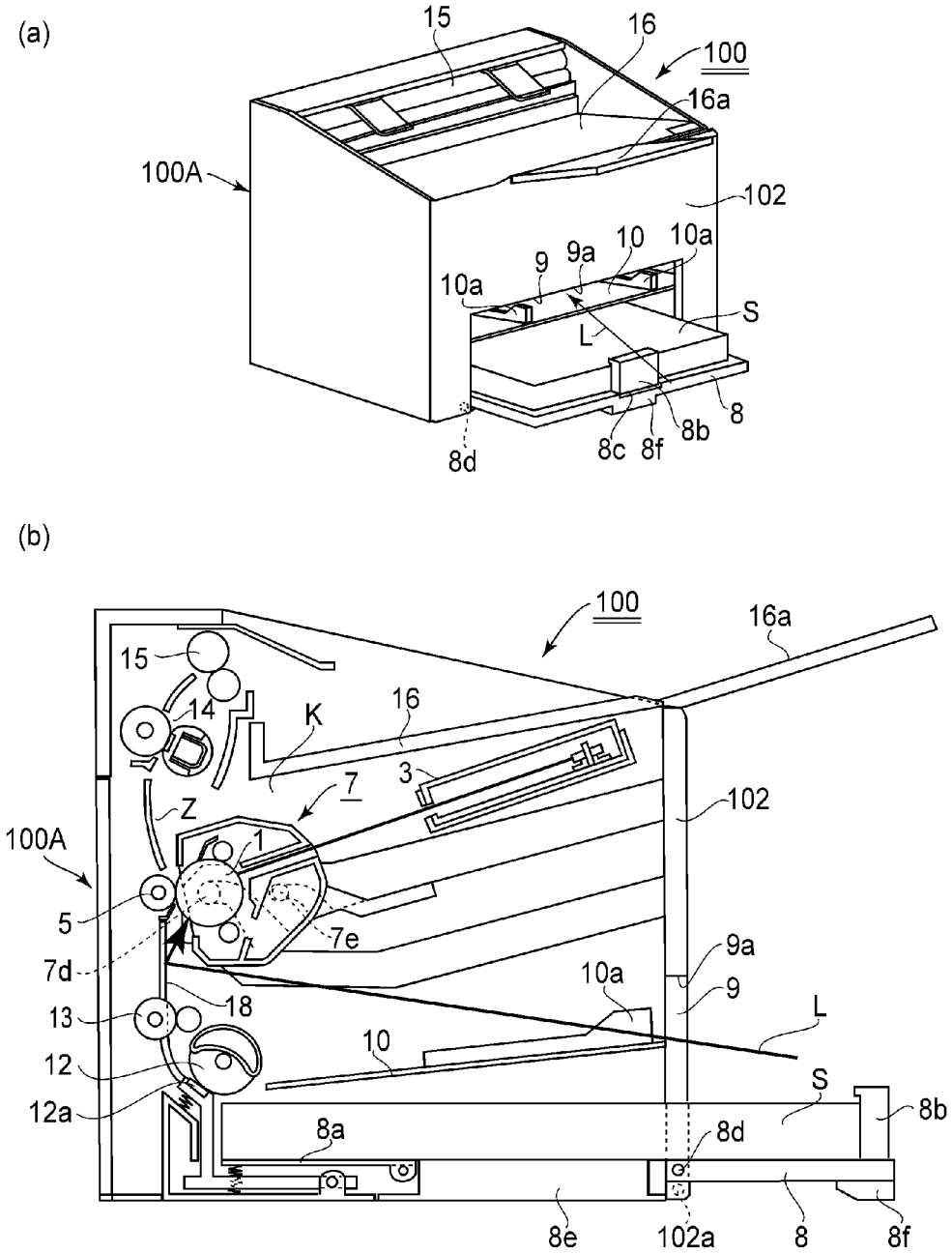

FIG. 4 is an illustration of entering external disturbance light.

Figure 5A:
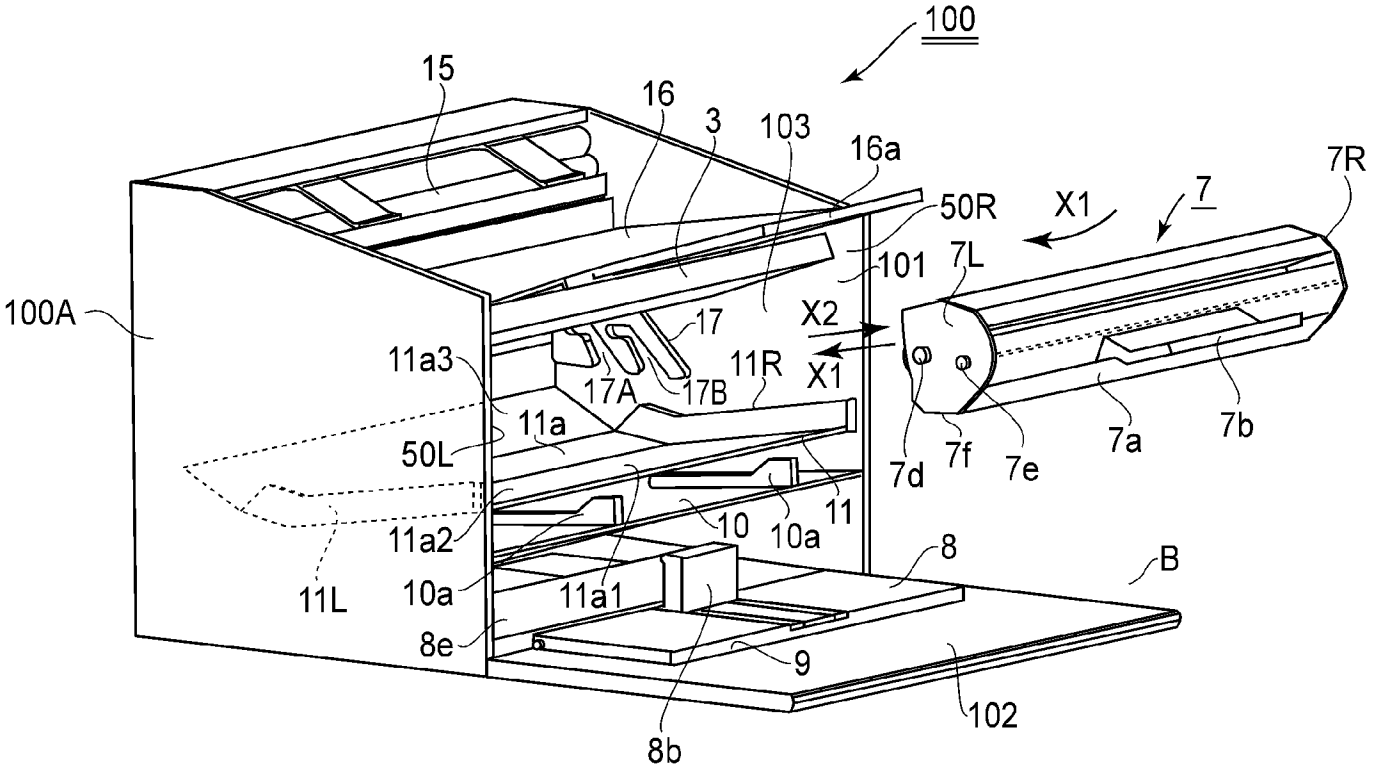
Figure 5B:
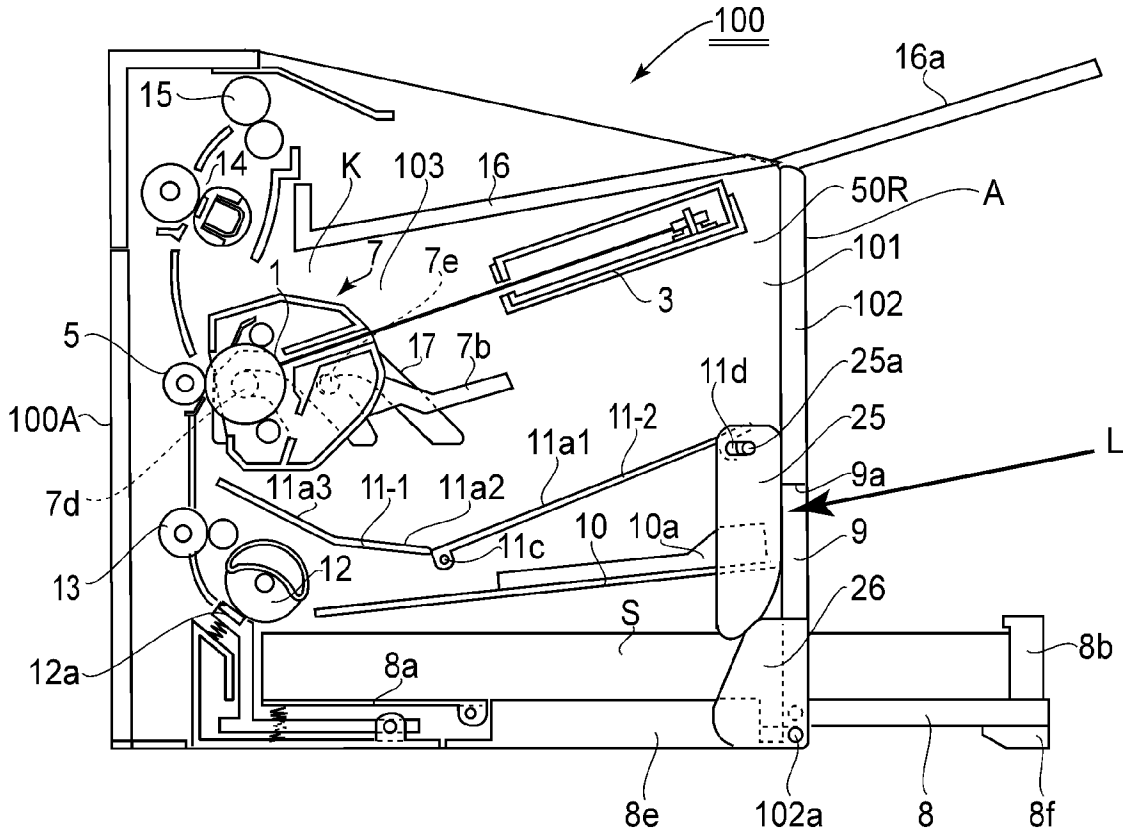

FIG. 5A is an illustration of an apparatus according to Embodiment 2, and FIG. 5B is an apparatus according to Embodiment 3.

Figure 6A:
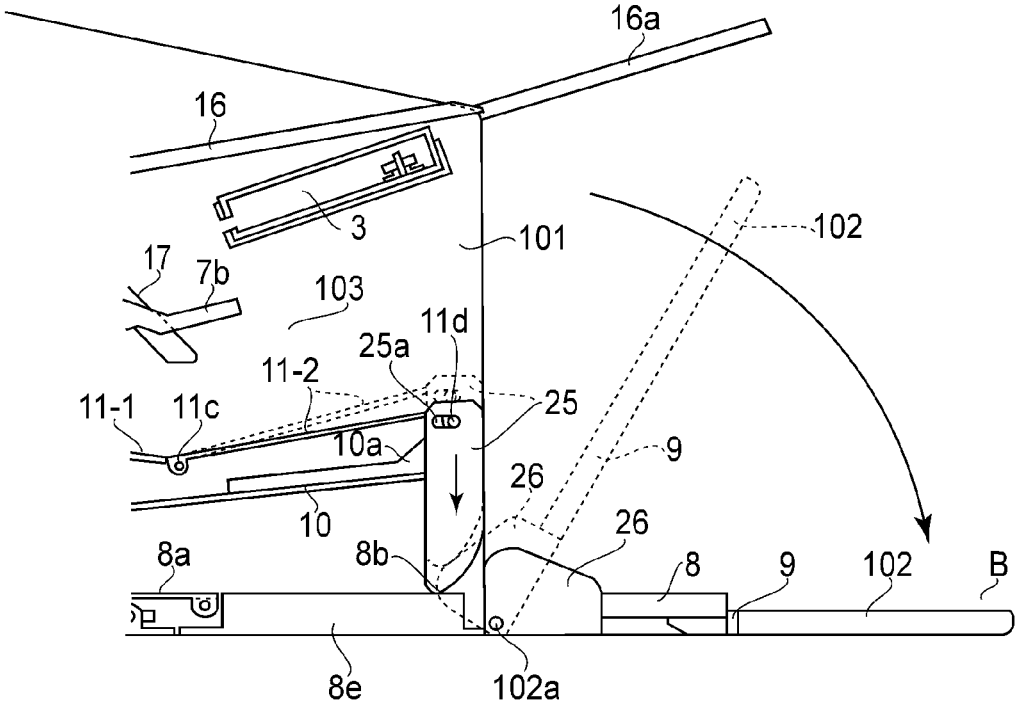
Figure 6B:
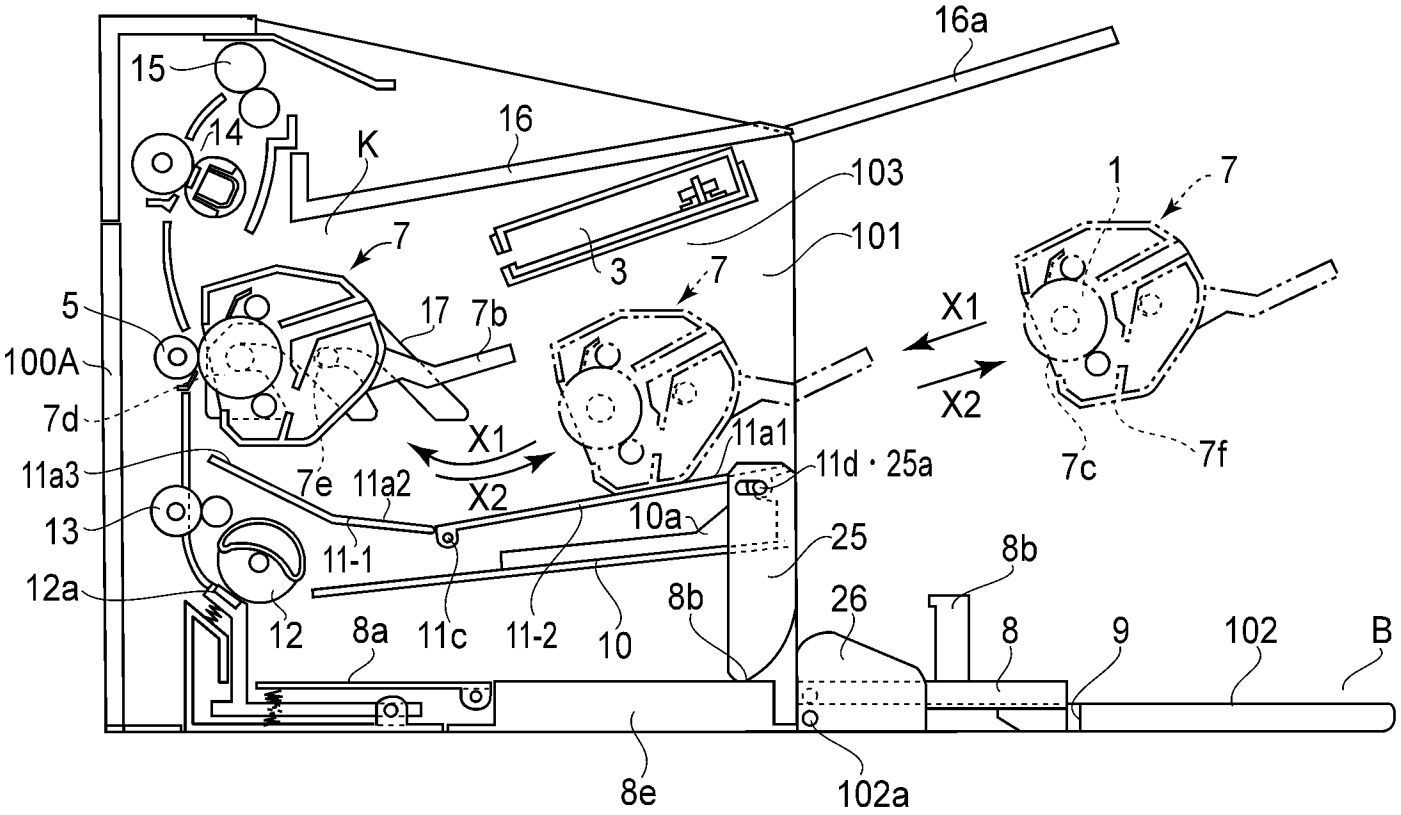

FIG. 6A and FIG. 6B are illustrations of a rotatable light blocking plate of the apparatus according to Embodiment 3.

Figure 7:
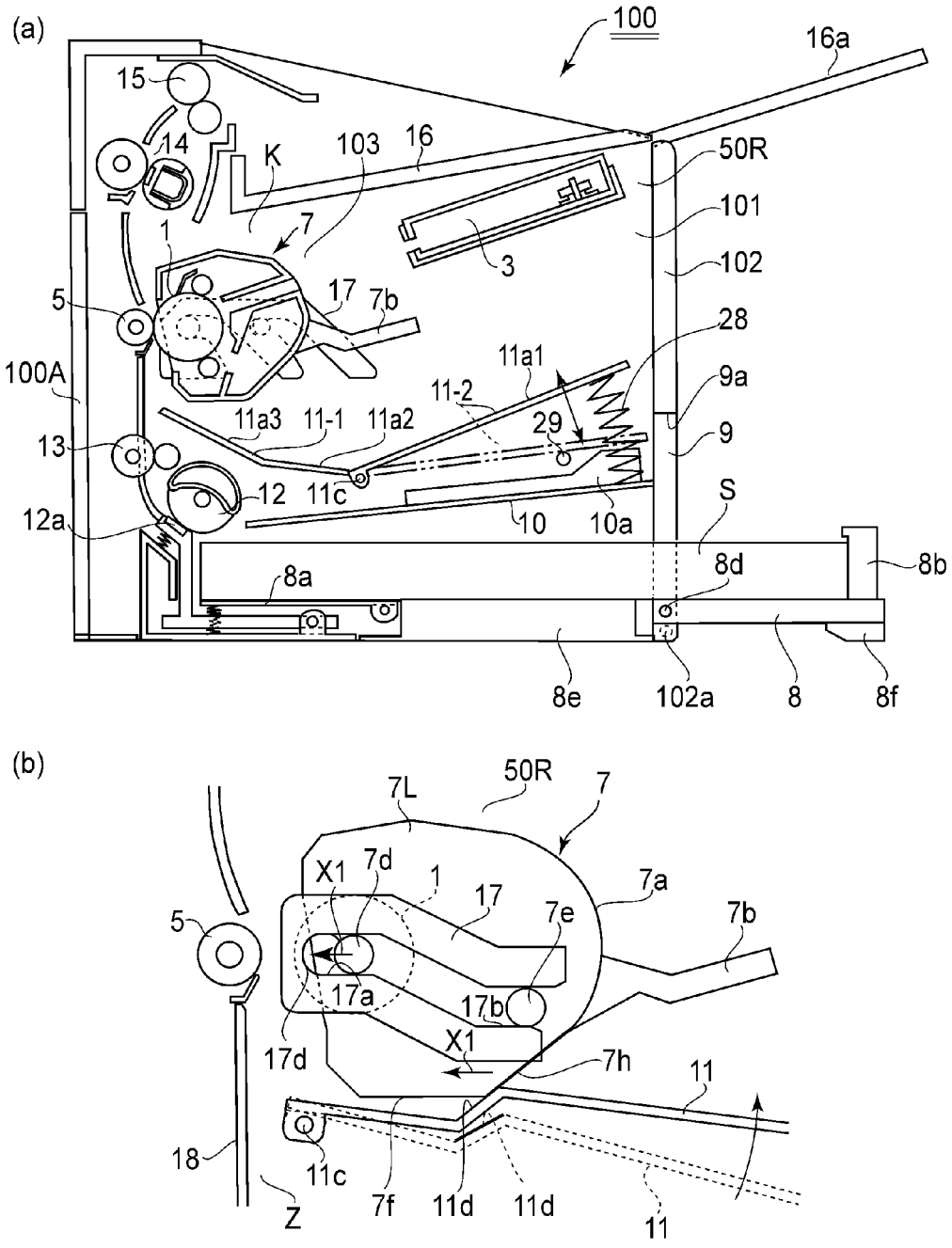

Part (a) of FIG. 7 is an illustration of an apparatus according to Embodiment 4, and (b) is an apparatus according to Embodiment 5.

Figure 8A:
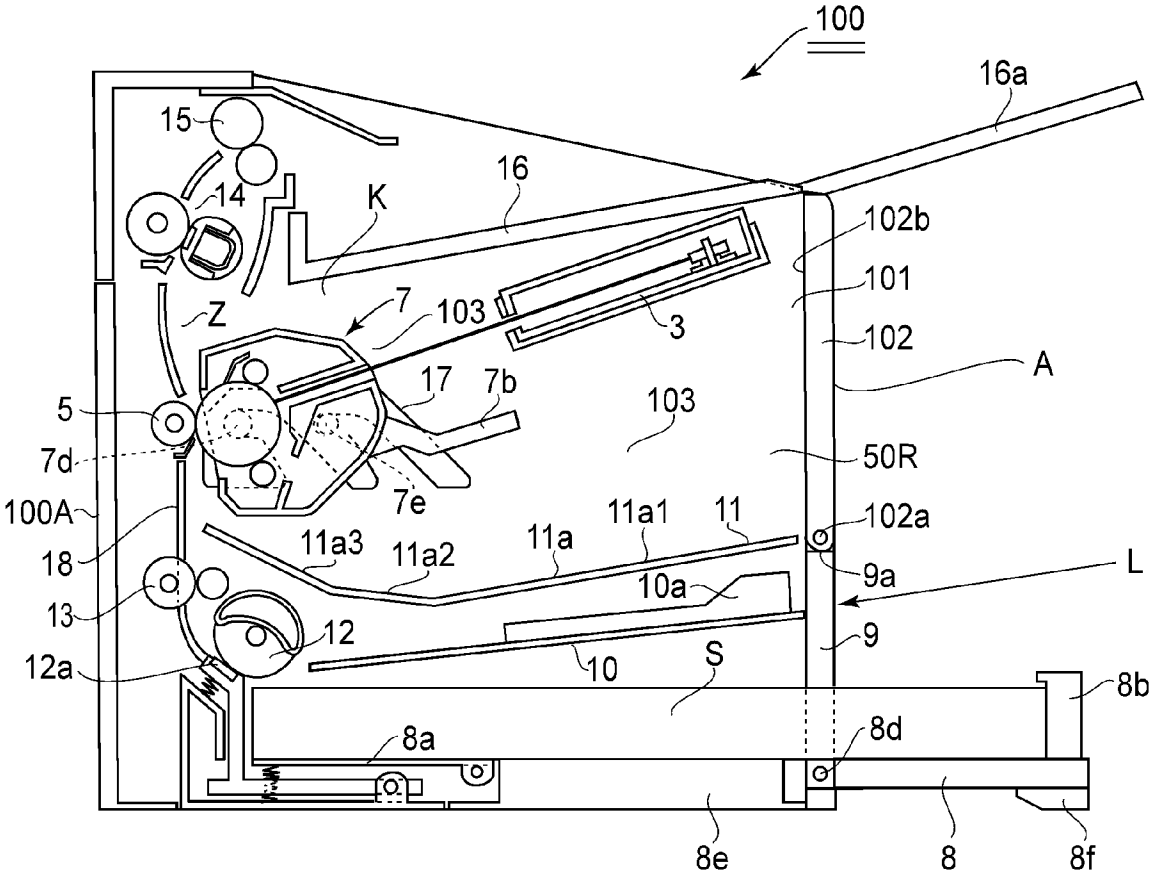
Figure 8B:
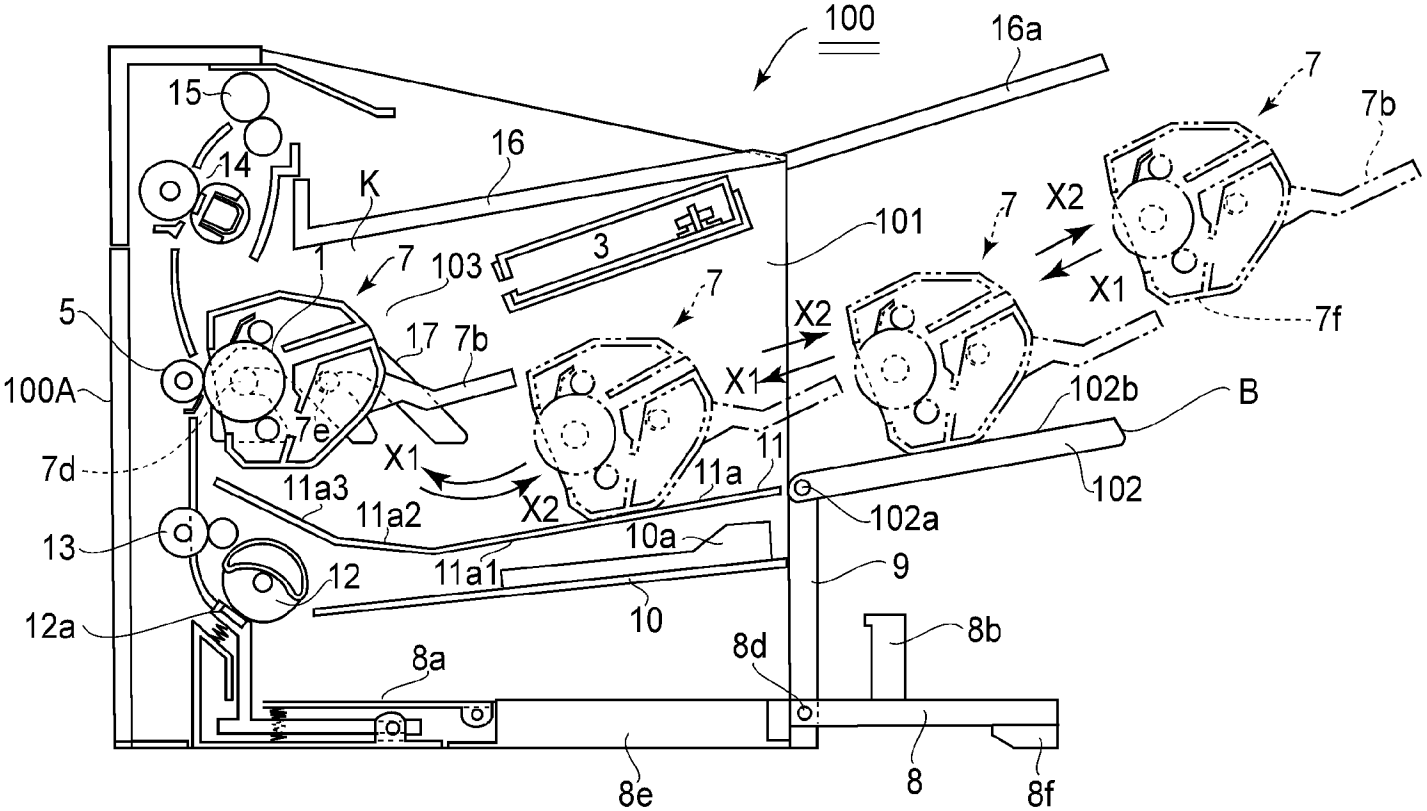

FIG. 8A is a right-hand side view of the apparatus of Embodiment 6 in the state that the door is closed, and FIG. 8B is a right-hand side view thereof in the state that the door is open.

Figure 9:
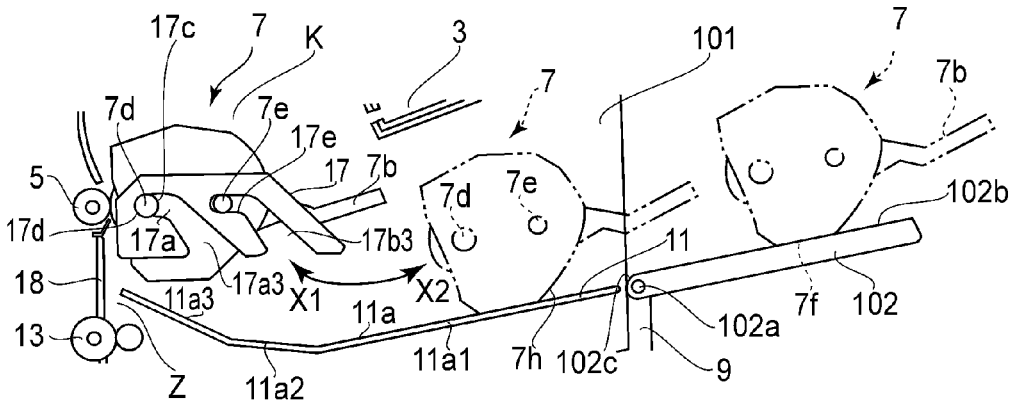
Figure 9:
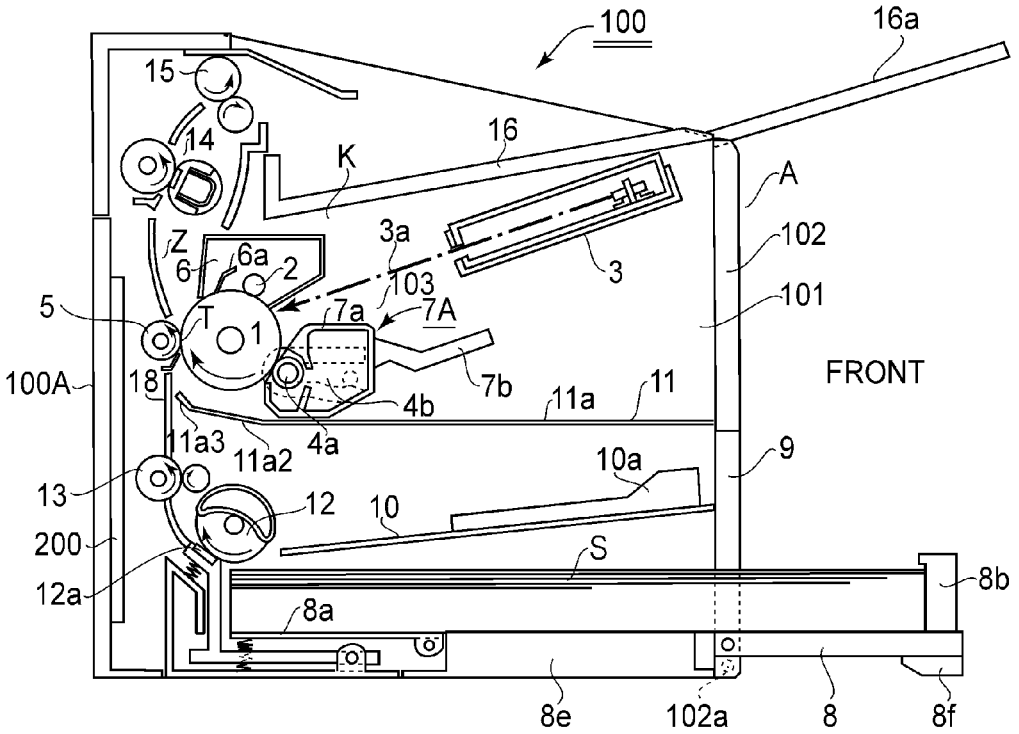

Part (a) of FIG. 9 is an illustration of a mounting or dismounting track of the cartridge of the apparatus of Embodiment 6, and (b) is an illustration of the apparatus of Embodiment 7.

Figure 10A:
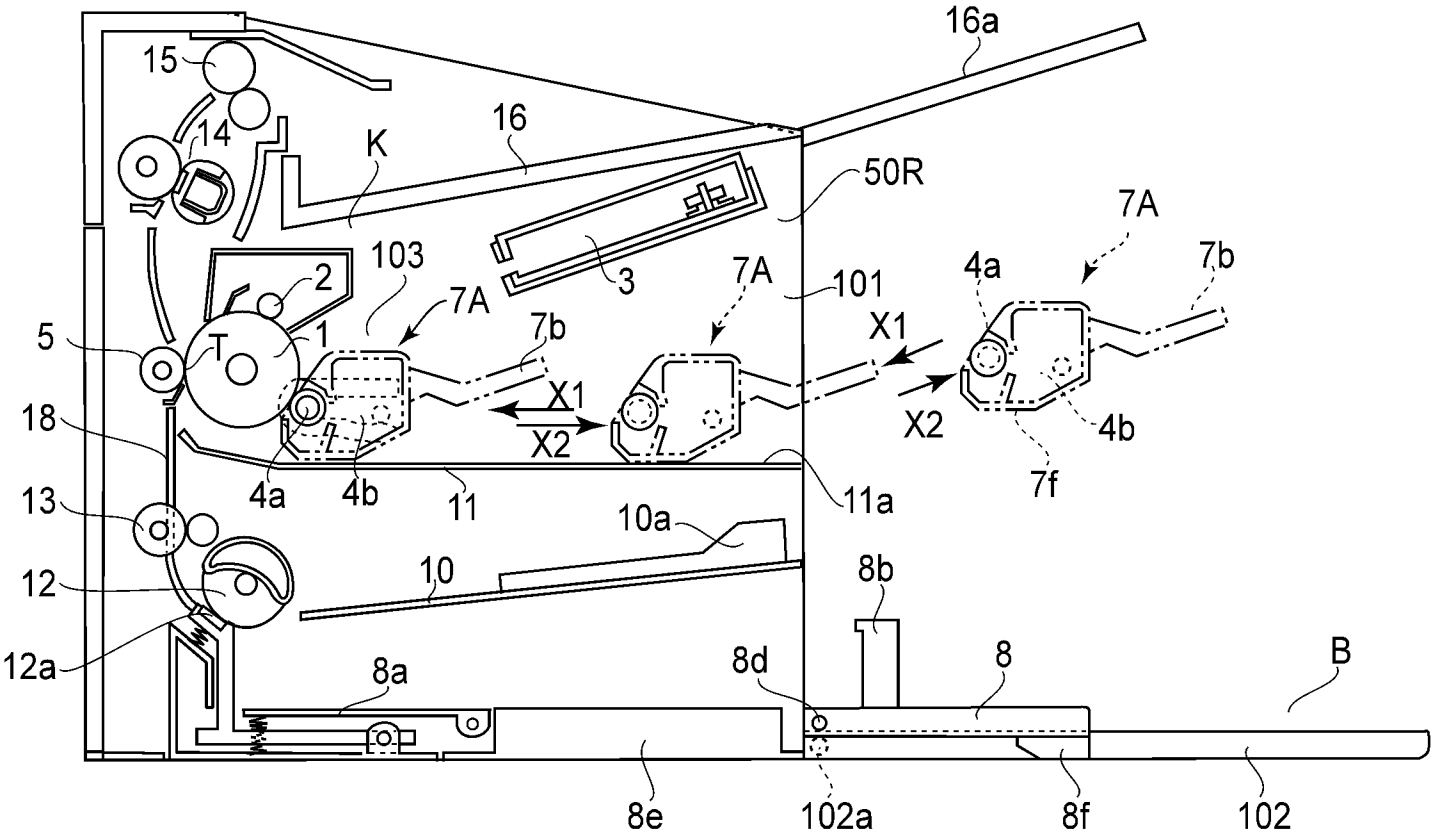
Figure 10B:
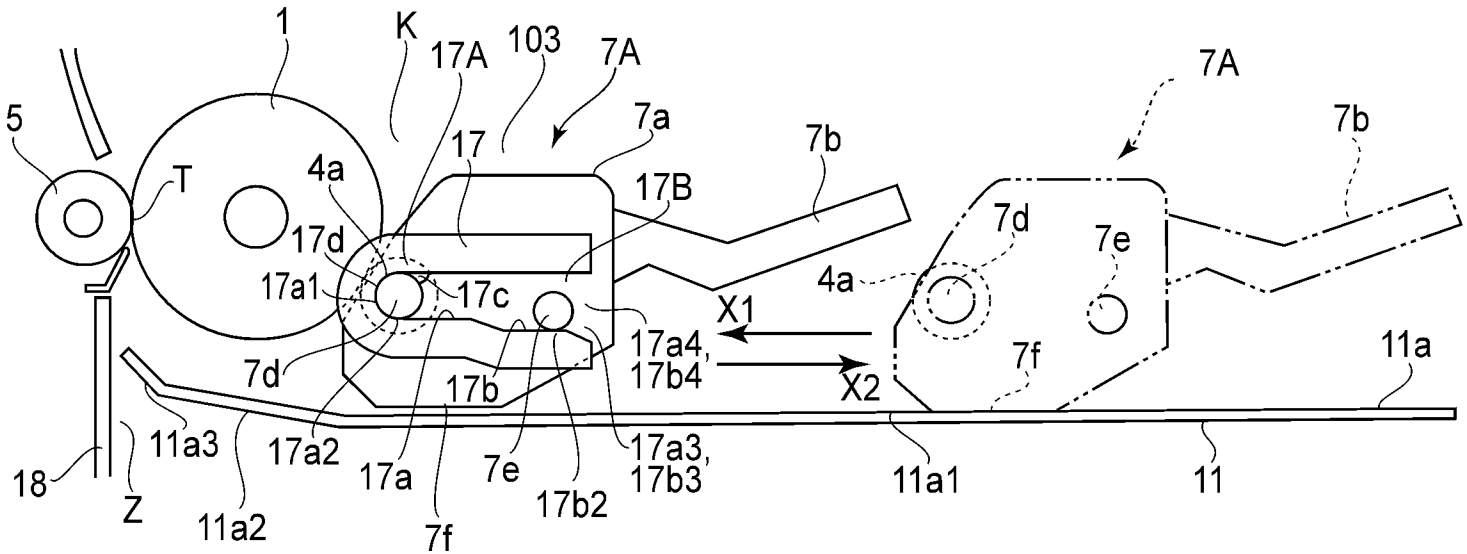

FIG. 10A and FIG. 10B are illustrations of insertion track or dismounting track of the developing cartridge.

Figure 11:
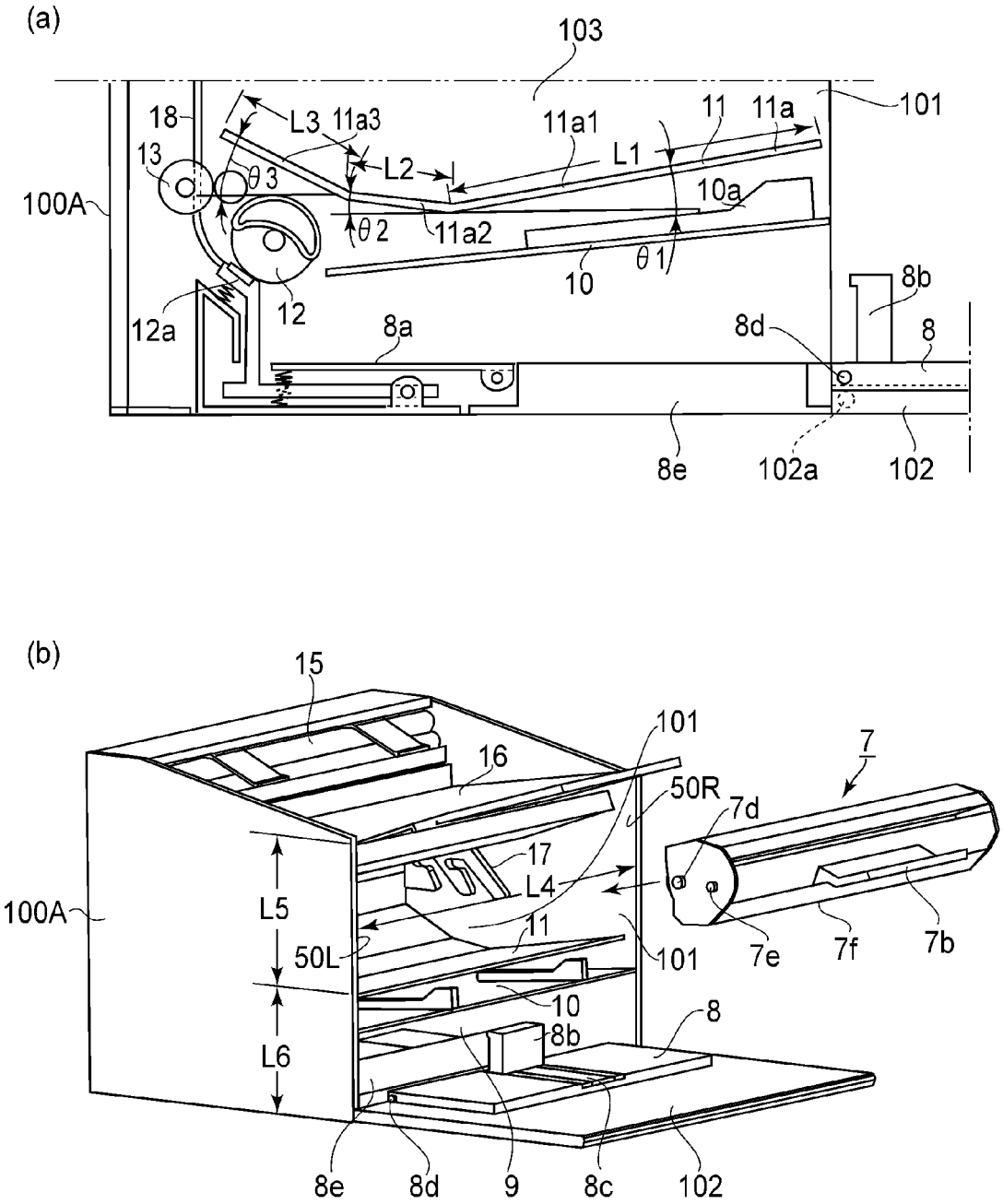

FIG. 11 shows dimensions of the light blocking plate in the apparatus of Embodiment 1, and (b) shows dimensions of the opening of the main assembly of the apparatus thereof.

DESCRIPTION OF THE PREFERRED EMBODIMENTS

Embodiment 1

(1) General Arrangement of Electrophotographic Image Forming Apparatus

Figure 1:
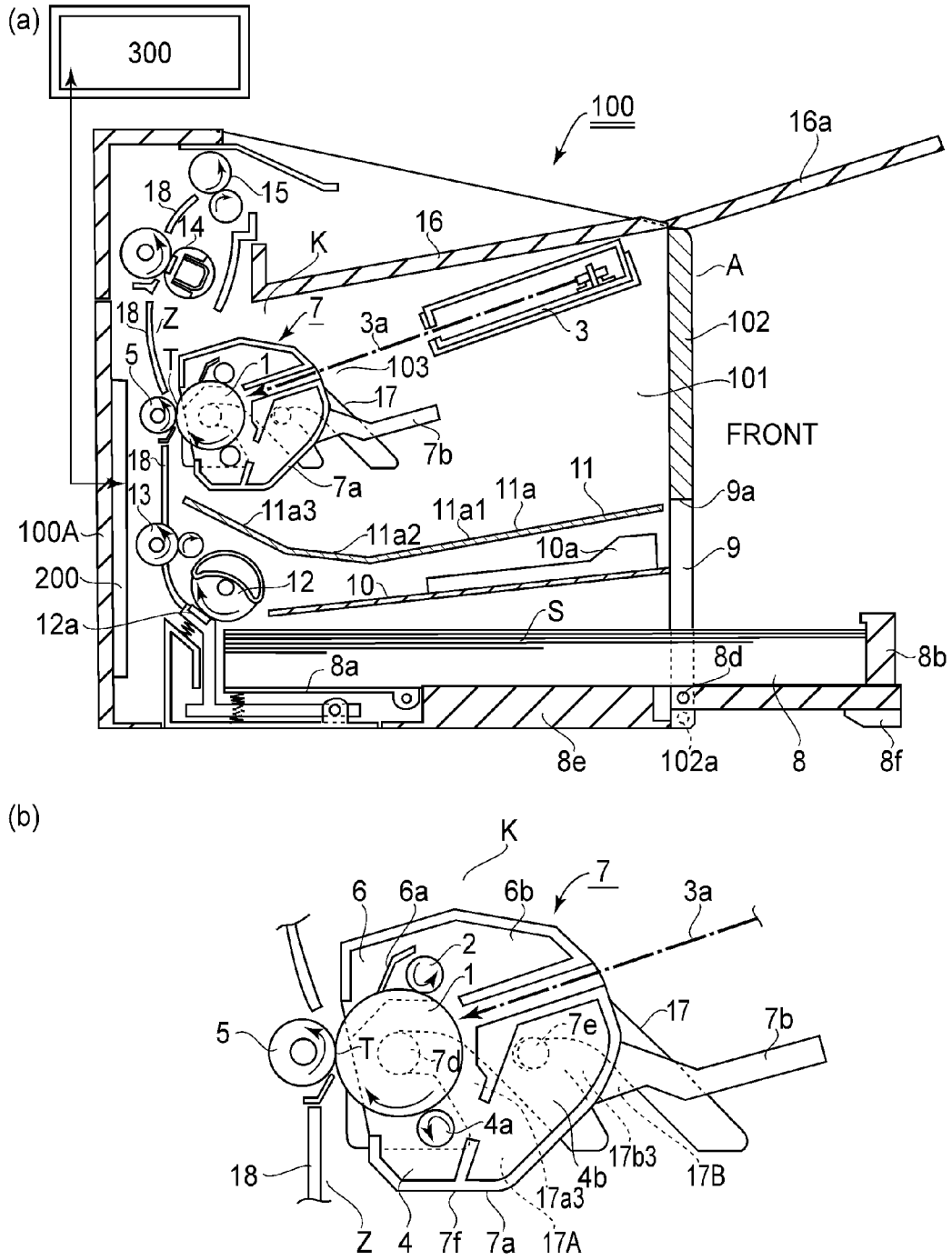

Part (a) of FIG. 1 is a right-hand side view of an electrophotographic image forming apparatus 100 according to Embodiment 1 of the present invention, and (b) is a partial enlarged view of part (a). The apparatus 100 in this embodiment is an electrophotographic laser beam printer capable of forming an image on a recording material S in the state that a cartridge 7 is mounted to the main assembly of the apparatus 100A. It forms the image on the sheet S on the basis of image information inputted from an outer host apparatus 300 to a control circuit portion a controller substrate) 200. The apparatus 300 is a personal computer (PC), an image reading apparatus (image reader), a network terminal, a word processor, a facsimile machine or the like, which is electrically connected with the control circuit portion 200.

Here, in the apparatus 100 of this embodiment, a front side is a side provided with a door (openable member or outer casing) 102 for a first opening (opening for mounting and dismounting of the cartridge) for mounting and dismounting the cartridge 7 relative to the main assembly 100A. A rear side is opposite the front side. A front-rear direction is a direction (frontward direction) from the rear side toward the front side of the main assembly 100A or an opposite direction (backward direction). Left and right are left-hand and right-hand as seen from the front side. A left-light direction is a direction from the right-hand to the left-hand (leftward direction) and the opposite direction (rightward direction). Up and down are up and down with respect to the direction of gravity.

The apparatus 100 includes an electrophotographic photosensitive drum on which an electrostatic latent image is formed (electrophotographic photosensitive member of a rotatable drum type, simply drum hereinafter). It further includes process means actable on the drum 1, the process means including a charging roller 2, a laser scanner unit 3, a developing device 4, a transfer roller 5, and a cleaning device 6 in this embodiment.

The charging roller (charging means) 2 is a contact-type charging means for charging uniformly the drum 1 to a predetermined polarity and potential. The unit (image exposure means) 3 outputs a laser beam 3*a* modulated correspondingly to an image signal inputted from the control circuit portion 200 to scanningly expose the surface of the drum 1 charged by the charger. By this, the unit 3 forms an electrostatic latent image corresponding to the image signal on the drum 1. The developing device (developing means) 4 visualizes in the electrostatic latent image formed on the drum 1 into a developed image (toner image) by a powder developer (powdery toner).

The developing device 4 includes a developing roller (developing member) 4*a* for supplying the developer onto the drum 1 to develop the electrostatic latent image formed on the drum 1, and a developer accommodating portion 4*b* accommodating the developer. Thus, the developing roller 4*a* develops the electrostatic latent image formed on the drum 1 with the developer.

A transfer roller (transferring means) 5 transfers the developed image formed on the drum 1 onto the sheet S. The cleaning device (cleaning means) 6 removes a residual developer from the surface of the drum 1 after the transfer roller 4*a* transfers the developed image onto the sheet S. The cleaning device 6 includes a cleaning blade (cleaning member) 6*a* and a residual developer accommodating portion 6*b*. The blade 6*a* is in contact to the surface of the drum 1 to scrape the residual developer off the surface of the drum 1. The developer scraped off the surface of the drum 1 is accommodated in an accommodating portion 6*b*.

In this embodiment, the drum 1, the charging roller 2, the developing device 4, the cleaning device 6 (four means) are unified into a cartridge. In other words, in this embodiment, these means are contained in a cartridge frame 7*a* with a predetermined mutual positional relation to constitute an integral cartridge. That is, in this embodiment, the cartridge is a process cartridge detachably mountable to main assembly 100A.

There is provided a sheet feeding tray (first feeding portion) 8 at a lower portion of the main assembly 100A. In the tray 8, sheets S of the predetermined size are stacked. The front side of the tray 8 is projected frontwardly of the apparatus 100 from a second opening (feeding opening) provided under said openable member) 102. The opening 9 is for permitting the sheets S into the main assembly 100. The user stacks the sheets S on the tray 8, accessing it through the opening 9.

Designated by reference characters 8*b* is a slider which is movable relative to the groove 8*c* and which is effective to regulate the trailing edges of the recording materials S stacked on the tray 8 ((a) of FIGS. 1, 2A, 2B and 4). Designated by reference 8*f* is a grip to be manipulated by the user rotating the tray 8.

Above the tray 8, there is provided a manual insertion tray (second feeding portion) 10. When a special sheet S is to be fed, the user accesses to the tray 10 through the opening 9, and stacks the sheet S thereon. A width regulating plate (side guide) 10*a* provided in the tray 10 regulates the sheets S in the widthwise direction, thus regulating the sheets S. The special sheet S may be a sheet having an extraordinary thickness or size, that is, a sheet of paper, a post card, an envelope, for example.

Thus the second opening 9 permits the sheet S to be introduced to the tray (first feeding portion) 8 or the tray (second feeding portion) 10. The tray 10 is inclined downwardly from the inside of the opening 9 to the neighborhood of the roller 12. The tray 10 is substantially as large as the main assembly 100A in the widthwise direction. The material of the tray 10 may be the same as that of a light blocking plate 11 and will be described hereinafter.

The light blocking plate (light blocking member) 11 is provided above the tray 10 and is effective to block at least a part of external disturbance light having entered inside the main assembly 100A through the opening 9 to prevent the light from reaching the drum 1. That is, the light blocking plate 11 prevents the external light having entered the main assembly 100A through the opening 9 from reaching the drum 1. The description will be made hereinafter in more detail.

In the rear side of the tray 10, there is provided a feeding roller 12. In addition, in the rear side of the main assembly 100A, a sheet feeding path Z extends from the roller 12 to an upper portion (discharging rollers 15) in the rear side in the main assembly of the apparatus 100A. The feeding path Z includes a feeding guide 18. There are provided registration rollers 13, a transfer roller 5, a fixing device (fixing heating apparatus) 14, discharging rollers 15.

The transfer roller 5 elastically contacts to the drum 1 to constitute a nip T. Fixing device 14 includes a fixing film unit and a pressing roller. On the upper surface of the main assembly 100A, there are provided a discharging tray 16 for receiving the printed sheets S. The tray 16 is provided with an extension tray 16*a* which extends frontwardly of the apparatus 100.

Figure 2A:
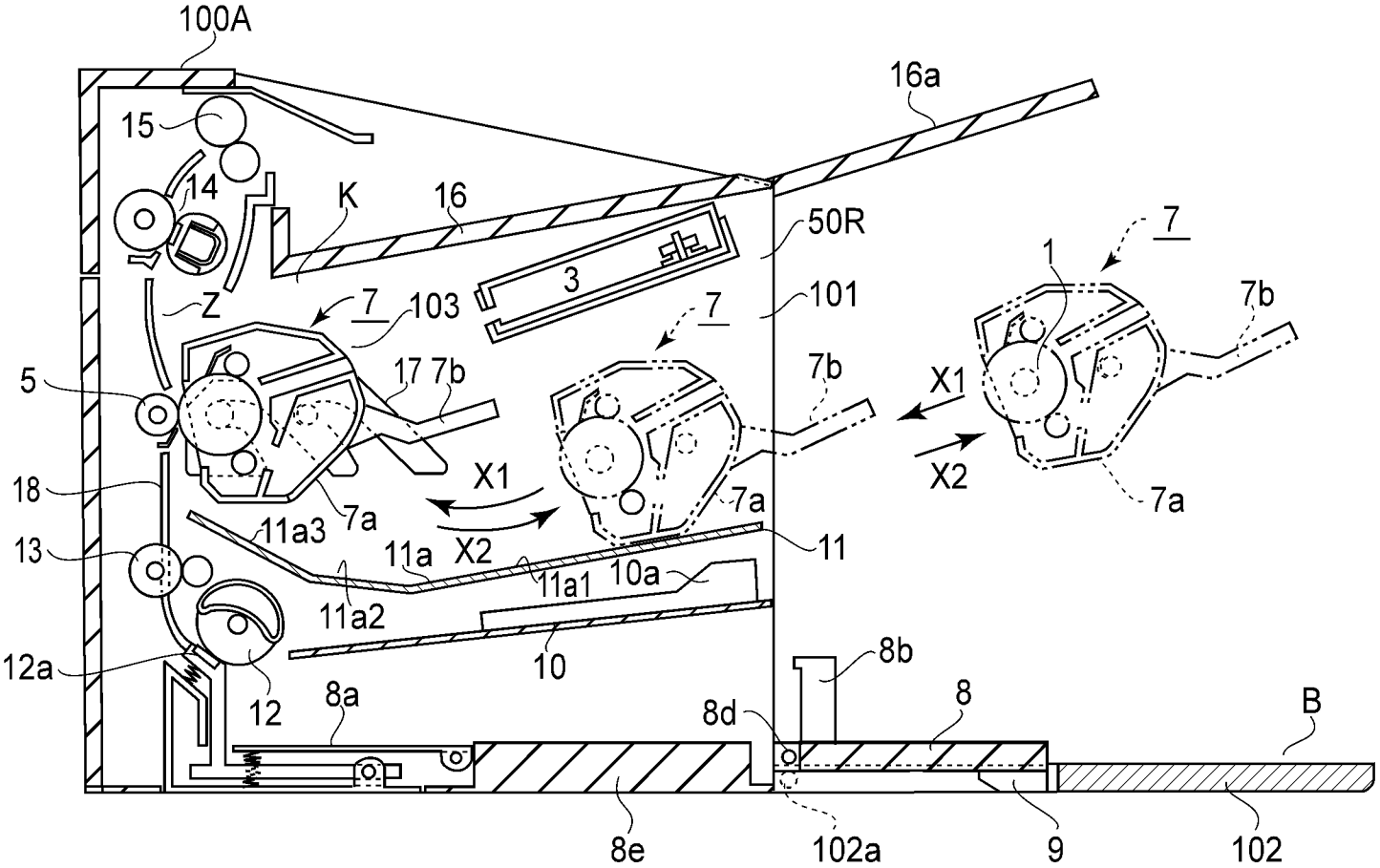
FIG. 2A is a right-hand side view of the apparatus in the state that the door is open.
Figure 2B:
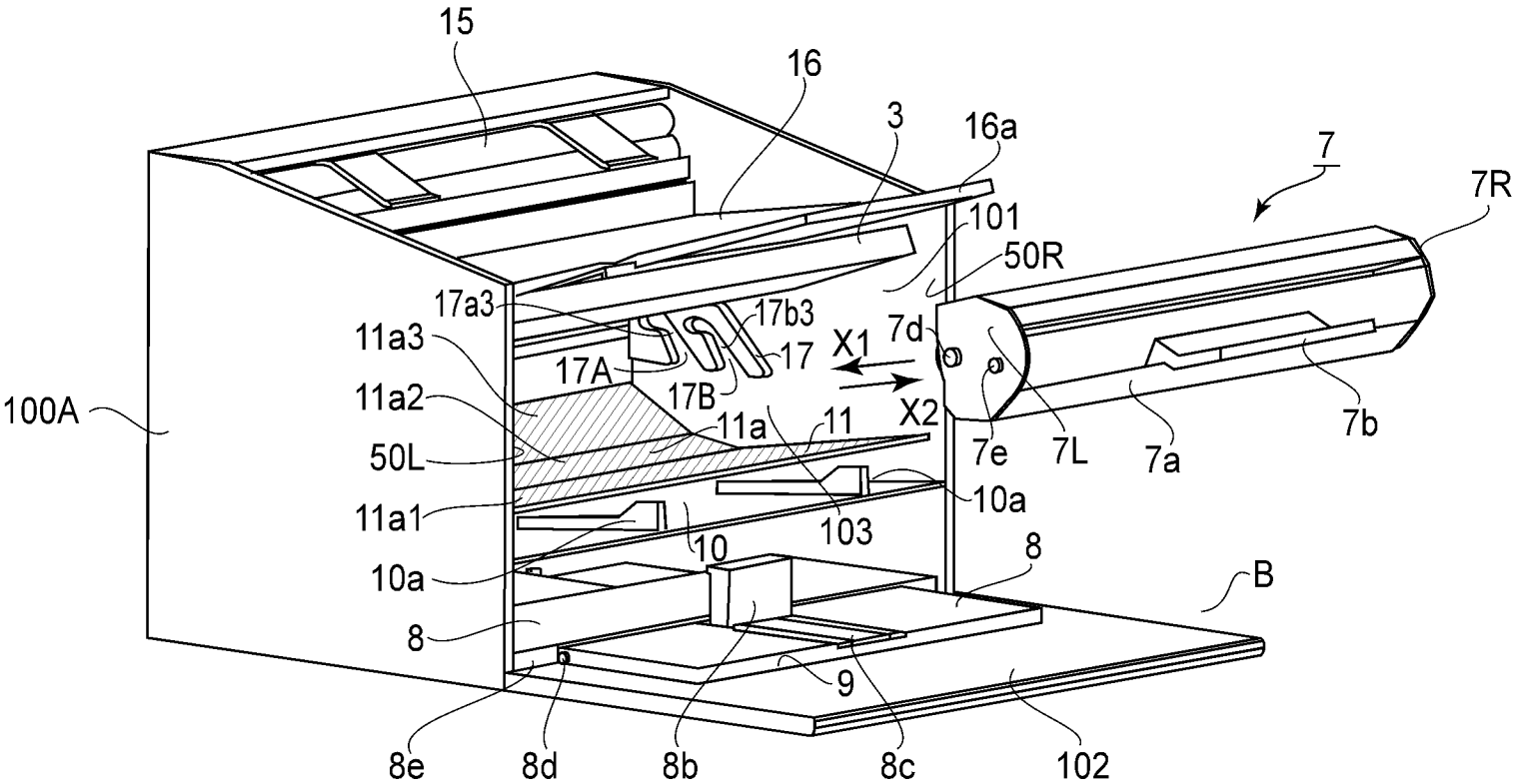
FIG. 2B is a perspective view of the apparatus in the state that the door is open.

As described above, in the front side of the apparatus 100, there is provided a first opening 101 which opens the entirety of the front side of the apparatus (FIGS. 2A and 2B). When the opening 101 is opened, the user can mount and demount the cartridge 7 relative to the main assembly of the apparatus 100A, and can load and unload the sheets S relative to the tray 8 and 10. Thus, the operationality is improved. The opening 101 is closable and openable by a door (openable member) 102 rotatable about a hinge 102*a* provided in the lower portion of the main assembly 100A.

The second opening 9 is provided below the door 102 corresponding to the width of the trays 8 and 10. That is, the opening 9 is provided on the door 102 in the lower portion of the door 102 and has a width smaller than that of the door 102. The opening 9 is openable and closable by the tray 8 rotatable about the hinge 8*d* provided at the lower portion of the main assembly 100A. By doing so, the tray (feeding portion, recording material stacking portion) 8 has a function of stacking the sheets S and also a function as a door for closing the opening 9. In the state that the door 102 opens the opening 101, the tray 8 rotates along an inside of the door 102 to be supported by the inside of the door.

In the state that the door 102 is closed, the tray 8 rotates outwardly about the hinge 8*d* to open the opening 9 provided in the door 102. In this state, the tray (rotation tray) 8*a* cooperates with a fixed tray portion 8*e* provided in the main assembly 100A to stack the sheets S ((a) of FIG. 1, FIGS. 2A and 2B). The tray 8 also functions as a cover openably closing the opening 9. As described above, the door 102 is rotatable about the hinge 102*a* relative to the main assembly of the apparatus 100A. By doing so, the door 102 is capable of opening and closing the opening 101.

The opening 9 provided in the door 102 is capable of being opened and closed by tray 8 rotatable about the hinge 8*d* relative to the door 102. By doing so, the operationality is improved, and the downsizing of the apparatus is accomplished. However, it is a possible alternative that a door for opening and closing the opening 9 may be additionally provided. A locking portion for locking the door 102 to the main assembly 100A when the door 102 is closed, and a locking portion for locking tray 8 to the door 102 when the tray 8 is closed, are omitted in the Figures for the sake of simplicity. However, the locking portions may be a hook type, a snap fit type or another known type.

The image forming operation is as follows. The control circuit portion 200 controls transaction of the information with the apparatus 300 to control the image formation sequence of the apparatus 100. The circuit portion 200 controls the apparatus 100 to execute the image formation in response to a print starting signal.

More particularly, the circuit portion 200 starts a driving motor (unshown) to rotate the drum 1 in the clockwise direction indicated by an arrow at a predetermined speed. The peripheral surface of the rotating drum 1 is uniformly charged to a predetermined polarity and potential by the charging roller 2. The charging roller 2 is in contact elastically to the peripheral surface of the drum 1 and is rotated by the rotation of the drum 1. The charging roller 2 is an electroconductive roller which is supplied with a predetermined charging bias voltage through a core metal thereof from a voltage source portion (unshown) in the main assembly 100A.

By his, the outer surface of the rotating drum 1 is uniformly charged to the predetermined polarity and potential. The thus charged drum 1 is exposed to light in accordance with image information by the unit 3. More particularly, the unit 3 outputs a laser beam modulated in accordance with the image signal inputted from the circuit portion 200 and scans the charged surface of the drum 1 with the laser beam. The exposed portion of the drum surface lowers in the absolute value of the potential so that an electrostatic latent image is formed in accordance with the image information. The electrostatic latent image is developed with the developer by the developing device 4 into a visualized or developed image.

More particularly, the electrostatic latent image is developed by the developing roller 4*a* with the developer accommodated in the accommodating portion 4*b*. To the developing roller 4*a* a predetermined developing bias voltage is applied by a voltage source portion (unshown).

On the other hand, and the circuit portion 200 rotates the feeding roller 12 at predetermined control timing. When the sheet supply from the tray 8 is selected, a lifter plate 8*a* of the tray 8 is raised. By this, an top surface of a rear side of the sheet S stacked on the tray 8 is brought into contact to a bottom surface of the roller 12, by which the topmost sheet S is picked up to the rear. The topmost sheet S is separated out into a feeding path Z by a separation pad 12*a* contacted to the roller 12. When the sheet feeding from the tray 10 is selected, the topmost sheet S on the tray 10 is picked up to the rear.

The sheet S is separated out into the feeding path Z by the separation pad 12*a*. The sheet S fed out into the feeding path Z reaches a pair 13 of registration rollers which is on-off controlled in its rotation at predetermined control timing. The roller pair 13 which is at rest temporarily stops the leading end of the sheet S to correct oblique feeding of the sheet S. The roller pair 13 is rotated at the predetermined control timing to introduce the sheet S to a transfer nip T where the drum 1 end of the transfer roller 5 are contacted to each other.

More particularly, the sheet S is fed by the roller pair 13 to the transfer nip in synchronism with the image formation on the drum 1. The transfer roller 5 is rotatably supported, and is press-contacted to the drum 1 toward the center of the drum 1 by an urging spring (elastic member unshown) with a predetermined elastic force. In the process of the sheet S passing through the transfer nip T, an image transfer bias voltage having a polarity opposite the charge polarity of the developer is applied to the transfer roller 5 from the voltage source portion (unshown). By this, the developed image formed on the peripheral surface of the drum 1 is transferred sequentially onto the sheet S.

The sheet S having received the developed image is separated from the surface of the drum 1. Thereafter, the sheet S is fed to the fixing device 14 and is subjected to a fixing process (fixing). The sheet S having been processed by the fixing device 14 is discharged by a pair of rollers 15 on a discharging tray 16 and extension tray 16*a* as a print (copy). The surface of the drum 1 after the transfer of the developed image on the sheet S, residual toner is scraped off by the cleaning device 6 and is prepared for the next image forming operation. After completion of the cleaning process, the surface of the drum 1 is charged again.

The apparatus 100 repeats the image formation using these means by repeating the charging, exposure, development, transfer, fixing and cleaning steps.

(2) Cartridge Exchanging Type

In the cartridge 7, the developer accommodated in the developing device 4 is consumed with the use. Therefore, the cartridge 7 is provided with a means (unshown) for detecting an amount of the developer in the cartridge 7, for example, and the circuit portion 200 compares the detected remaining amount with a preset threshold for cartridge lifetime forenotice. When the detected remaining amount becomes smaller than the remaining amount value, the lifetime forenotice of the cartridge 7 is displayed on a display portion (unshown) of the apparatus 100. By this, the user is prompted for the preparation for the cartridge to exchange, or is prompted for the exchange of the cartridge, thus maintaining the quality of the output prints.

In the apparatus 100 of this embodiment, when the cartridge 7 is to be exchanged, the door 102 of the front side of the apparatus 100 is opened. By this, the opening 101 of the main assembly 100A is opened. Then, the user exchanges the cartridge 7 through the opening 101. Thus, a so-called front access type is used wherein the cartridge is exchanged in the front side of the apparatus. As described above, the front side of the main assembly 100A is provided with the opening 101 for permitting passage of the cartridge 7 to insert the cartridge 7 into the main assembly 100A and to take out the cartridge 7 from the main assembly 100A.

The main assembly 100A is provided with a door (openable member) 102 movable between a close position A (FIG. 1, (a)) for closing the opening 101 and an open position B (FIGS. 2A and 2B) for opening the opening 101. In this embodiment, the door 102 is rotatable relative to the main assembly 100A about a hinge shaft (fulcrum) 102*a* at the bottom end portion of the door. That is, the door 102 rotates about the shaft 102*a* upwardly to move to the close position for closing the opening 101. The closed door 102 is maintained in the close position by locking with the main assembly 100A by said locking portion (unshown).

In addition, the closed door 102 can be moved to the open position B for opening the opening 101 (FIGS. 2A and 2B) by rotating it downwardly to the front side about the shaft 102*a* by releasing the locking portion. By this, the opening 101 is widely opened. In the embodiment, substantially the entirety of the front side is open by opening the door 102 (FIGS. 2A and 2B).

In this embodiment, the opening 9 for loading the sheets S is provided below the door 102, and when the door 102 is closed, the front side of the tray 8 is projected frontwardly through the opening 9 (FIG. 1, (a)). Thus, the opening 9 is for setting the sheets S into the tray 8 and into the tray 10.

When the door 102 takes the open position B, the front side of the tray 8 is inside the opening 9. The door 102 and the tray 8 are opened and closed by the user. The opening 9 and the opening 101 may be an integral opening or may be separate openings.

The user opens the door 102. Then, the user can see the cartridge mounting portion 103 (and the trays 8 and 9) in the main assembly 100A through the opening 101. The mounting portion 103 is the space defined by the upper surface 11*a* of the light blocking plate 11, the lower surface of the discharging tray 16, inner surfaces of the left and right side frames 50L, 50R (FIG. 2B) of a main frame of the main assembly 100A. The tray 10, the light blocking plate 11, the unit 3 and the tray 16 are disposed at predetermined positions between the left and right side frames 50L, 50R.

In the rear side of the mounting portion 103, the inner surfaces of the frames 50L, 50R are provided with cartridge guides (main assembly side guide portion) 17 symmetrically, respectively. The guide 17 guides the cartridge 7 in the predetermined direction relative to the main assembly 100A. The predetermined direction is oriented toward the mounting portion 103 in this embodiment.

The mounting portion 103 is the space for mounting the cartridge 7 to the image formation position K. The image formation position K is the position for the cartridge 7 to form the developed image on the sheet S. In this embodiment, it is the position shown in FIGS. 1, 2A and 2B, where the drum 1 is in contact with the transfer roller 5. However, the image formation position K is not limited to the position where the drum 1 and the transfer roller 5 are contacted with each other.

The cartridge 7 of this embodiment is elongated in the axial direction (longitudinal direction) of the drum 1. The cartridge 7 is mounted and dismounted relative to the main assembly 100A in a direction substantially perpendicular to the longitudinal direction of the drum 1 (FIGS. 2A and 2B). A part of the surface of the drum 1 is exposed through a slit opening 7*c* provided in the cartridge frame 7*a* and extending in the longitudinal direction ((a) of FIG. 3A). In the side opposite from the opening 7*c*, there is provided a grip to be handled by the user.

The side covers 7L and 7R at one and the other longitudinal end portions of the frame 7*a* are provided with first and second positioning cylindrical bosses 7*d* and 7*e* (projection as each of the opposite ends of the cartridge 7, cartridge side portion-to-be-guided). The first positioning boss (first cartridge side portion-to-be-positioned) 7*d* is provided coaxially with the rotational axis of the drum 1. The second positioning boss (second cartridge side portion-to-be-positioned) 7*e* is provided upstream of the first positioning boss 7*d* with respect to the inserting direction (mounting direction) X1 in which the cartridge 7 is inserted into the main assembly 100A.

The bosses 7*d*, 7*e* are columnar. The first positioning boss 7*d* and the second positioning boss 7*e* are provided projected outwardly from the one end surface and other end surface of the cartridge 7. The boss 7*d* is coaxial with the drum 1. By doing so, the cartridge 7 is positioning on the basis of the drum 1 relative to the main assembly 100A. The longitudinal direction of the cartridge 7 is a longitudinal direction of the drum 1 and/or a longitudinal direction of the developing roller 4*a*.

The cartridge 7 is mounted to the mounting portion 103 in the following state. The description will be made referring to (b) of FIG. 3A. The first positioning boss 7*d* of the cartridge 7 is engaged with a first groove portion (first main assembly side positioning portion, first guide portion) 17*a*. In addition, the second positioning boss 7*e* is engaged with a second groove portion (second main assembly side positioning portion, second guide portion) 17*b*. In such a state, the cartridge 7 is mounted to the mounting portion 103 (FIG. 3A (b)).

The groove portions 17*a*, 17*b* are provided in the cartridge guide provided in main assembly 100A (main assembly side guide, first main assembly side guide, second main assembly side guide) 17. The guides 17 are provided in the main assembly 100A at one and the other longitudinal ends of the cartridge 7 mounted to the mounting portion 103 so as to be opposed to each other.

The guide groove portion (first guide portion) 17*a*3 is provided with an opening 17*a*4 at the lower end, and is inclined diagonally upward toward the mounting position (mounting direction X1). The guide groove portion 17*a*3 is provided with the groove portion 17*a* at the end thereof. The groove portion 17*a* is provided with an abutting portion 17*a*1 and a supporting portion 17*a*2.

The guide groove portion (second guide portion) 17*b*3 is provided with an opening 17*b*4 at the lower end, and is inclined diagonally upward toward the mounting position (mounting direction X1). The guide groove portion 17*b*3 is provided with the groove portion 17*b* at the end thereof. The groove portion 17*b* is provided with an abutting portion 17*b*1 and a supporting portion 17*b*2. The abutting portion 17*a*1 has an arcuate configuration to be abutted by the boss 7*d*, and the abutting portion 17*b*1 has an arcuate configuration to be abutted by the boss 7*e*. Normally, the boss 7*e* is spaced from the abutting portion 17*b*1 ((b) of FIG. 3A).

The supporting portion 17*a*2 is flat so as to support the boss 7*d*. The supporting portion 17*b*2 is flat so as to support the boss 7*e*. More particularly, the boss 7*d* is supported by the groove portion 17*a* and abuts an abutting portion 17*a*1 (end surface) of the groove portion 17*a*, wherein the abutment state is maintained by an elastic force (urging force) of a spring (elastic member) 17*c*. The spring 17*c* maintains the boss 7*d* at a predetermined position in the groove portion 17*a* by the elastic force thereof. The boss 7*e* abuts the groove portion 17*b* to limit rotation of the cartridge 7.

The boss 7*d* is positioned by the groove portion 17*a* with high accuracy, and the boss 7*e* is positioned in the groove portion 17*b* roughly. By doing so, the cartridge 7 is positioned in the main assembly 100A with high accuracy on the basis of the drum 1. When the cartridge 7 receives a rotational force for rotating the drum 1 (developing roller 4*a*) from the main assembly 100A, the boss 7*e* is brought into contact to the inner surface of the groove 17*b*, by which the cartridge 7 is prevented from rotating about the bosses 7*d*.

By this, the cartridge 7 is maintained stably in the mounting attitude of the cartridge 7 in the state that the cartridge is mounted to the mounting portion 103. In the state that the cartridge 7 is mounted, the transfer roller 5 is elastically abutted to the surface of the drum 1 exposed through the opening 7*c* of the frame 7*a* to form the transfer nip T. In addition, the door 102 is closed. By this, the drive input portion (unshown) of the cartridge 7 mounted to the mounting portion 103 and the drive output portion (unshown) of the main assembly side of the apparatus are brought into contact to each other.

In addition, the input portion (unshown) of the cartridge 7 and the bias output portion (unshown) of the main assembly side of the apparatus are brought into contact to each other. In such a state, the apparatus 100 is in the state that the image forming operation is possible. The bosses 7*d*, 7*e* are provided on one and the other longitudinal ends of the cartridge 7. The cartridge guide 17 is provided in the main assembly 100A, and is disposed at the one and the other longitudinal ends of the cartridge 7 mounted to the mounting portion 103. In the drawing, only one of them is shown.

1. Dismounting of Cartridge:

The cartridge 7 mounted to the mounting portion 103 is dismounted from the main assembly 100A in the following manner. The user opens the door 102 to open the opening 101. An interrelating mechanism (unshown) disconnects, in response to the opening movement of the door 10, the drive input portion (unshown) and the bias voltage input portion (unshown) of the mounted cartridge 7 from the main assembly side drive output portion (unshown) and the bias output portion (unshown) of the main assembly, respectively. Then, the grip 7*b* of the mounted cartridge 7 can be seen through the opening 101.

The user inserts his or her hand through the opening 101, grips the grip 7*b*, and pulls the cartridge 7 against the elastic force of the spring (elastic member) 17*c* to the front in the cartridge dismounting direction X2 ((b) of FIG. 3A). By this, the boss 7*d* passes the spring 17*c* while flexing it, and retracts to the guide groove portion 17*a*3 directing diagonally downward from the groove portion 17*a* to the groove portion 17*a*. The boss 7*e* also retracts from the groove portion 17*b* to the guide groove portion 17*b*3 directing diagonally downward continuing to the groove portion 17*b*.

The cartridge 7 lowers from the guide 17 by the bosses 7*d*, 7*e* sliding down on the groove portions 17*a*1, and 17*b*1. And, the bosses 7*d* passed by the opening 17*a*4 downwardly, and the boss 7*e* moves beyond the opening 17*b*4 downwardly. The lower surface 7*f* of the frame 7*a* is stopped by the upper surface 11*a* of the light blocking plate (light blocking member) 11. The lower surface 7*f* is a flat surface. At this time, the boss 7*d* is taken out through the opening 17*a*4, and the boss 7*e* is taken out through the opening 17*b*4. Therefore, the cartridge 7 is in the state of disengaged from the guide 17.

The user continues to pull the cartridge in the dismounting direction X2 along the upper surface 11*a* of the light blocking plate, that is, using the light blocking plate 11 as a guide. The upper surface 11*a* is a flat surface. By this, the cartridge 7 can be taken out through the opening 101 to the outside of the main assembly 100A. The guide groove portion 17*a*3 is inclined diagonally upward toward the rear side of the main assembly 100A in the mounting direction X1 of the cartridge 7. In other words, the guide groove portion 17*a*3 inclines diagonally downward in the dismounting direction X2 of the cartridge 7 toward the front side of the main assembly 100A.

The guide groove portion 17*b*3 is inclined diagonally upward toward the rear side of the main assembly 100A in the mounting direction X1 of the cartridge 7. In other words, the guide groove portion 17*b*3 inclines diagonally downward in the dismounting direction X2 of the cartridge 7 toward the front side of the main assembly 100A. Therefore, the cartridge 7 can be mounted smoothly to the mounting portion 103 only by pushing the cartridge 7 toward the mounting portion 103. On the other hand, the user can smoothly take the cartridge 7 out of the mounting portion 103 only by pulling the cartridge 7 from the mounting portion 103.

When the cartridge 7 moves along the upper surface 11*a* of the light blocking plate, the flat lower surface 7*f* is contacted to the flat upper surface 11*a*. By doing so, the inclination angle of the cartridge 7 relative to the advancing direction of the cartridge 7 is regulated.

2. Mounting of Cartridge:

The mounting of the cartridge 7 to the main assembly 100A (mounting portion 103) is opposite the dismounting operation, as follows. FIG. 3B is a detailed illustration of the insertion track of the cartridge 7. As will be understood, the insertion track of the cartridge 7 is the same as the movement locus at the time of dismounting the cartridge 7 from the mounting portion 103. Therefore, the movement locus shown in FIG. 3B is used as the track of the cartridge 7 dismounting.

The user opens the door 102 to open the opening 101. The user grips the grip 7*b*. And, the user inserts the cartridge 7 through the opening 101 toward the mounting portion 103 with the opening 7*c* side at the leading end. At this time, that lower surface 7*f* of the frame 7*a* is placed on the upper surface 11*a* of the light blocking plate 11. The cartridge 7 is pushed into the main assembly toward the mounting portion 103 along the upper surface 11*a* of the light blocking plate, using the light blocking plate 11 as a guide. At this time, the cartridge 7 is regulated in the lateral direction by the inner surfaces of the side frames 50L, 50R.

More particularly, the cartridge 7 is pushed toward the mounting portion 103 while being regulated in the moving direction by the inner surfaces of the frames 50L, 50R. The light blocking plate 11 is provided with a rear side inclined surface 11*a*1, 11*a*2 ascending in the cartridge inserting direction X1.

In the process of the cartridge 7 being pushed to the neighborhood of the guide 17 by the user, the cartridge 7 lowers along the descending inclined surface 11*a*1 of the light blocking plate 11 and then rises along the ascending inclined surface 11*a*2, 11*a*3 of the guide 17. Here, as described hereinbefore, the inclination angle of the cartridge 7 relative to the advancing direction is regulated. Then, the boss 7*d* reaches the opening 17*a*4, and the boss 7*e* reaches the opening 17*b*4. More particularly, the cartridge reaches the position where the boss 7*d* is brought into contact to the inner wall of the opening 17*a*4 (inner wall of the guide groove portion 17*a*3), and the boss 7*e* is brought into contact to the inner wall of the opening 17*b*4 (inner wall of the guide groove portion 17*b*3).

Since the inclined surface 11*a*1 is descending, the space for permitting placement of the cartridge 7 on the light blocking plate 11 can be large. In addition, the space for permitting dismounting of the cartridge 7 from the light blocking plate 11 can be large. Therefore, the operationality when the cartridge 7 is mounted or dismounted from the light blocking plate 11 can be improved.

By the user further pushing the cartridge, the boss 7*d* rises along the inner surface of the groove portion 17*a*3, and the boss 7*e* rises along the inner surface of the groove portion 17*b*3. By this, the cartridge 7 rises away from the upper surface 11*a* of the light blocking plate 11 (FIG. 3B). By the cartridge 7 being further pushed, the boss 7*d* passes through the groove portion 17*a*1 to reach the groove portion 17*a*. In addition, the boss 7*e* passes through the groove portion 17*b*1 to reach the groove portion 17*b*. At this time, the boss 7*d* compresses the spring 17*c* and enters the groove portion 17*a*. Then, the boss 7*d* abuts to the abutting portion (end surface) 17*a*1.

The abutted state is maintained by the elastic force of the spring 17*c*. With the state, the drum 1 is contacted to the transfer roller 5. The first guide portion 17A positions the boss 7*d* which is disposed downstream of the boss 7*e* at one and the other end portions of the cartridge 7 with respect to the mounting direction. The first guide portion 17A is provided with the opening 17*a*4, the groove portion 17*a*3 and the groove portion 17*a* (abutting portion 17*a*1, supporting portion 17*a*2). The first guide portion 17A guides the boss 7*d* upwardly when the user pushes the cartridge 7.

The boss 7*e* reaches the groove 17*b*. By this, the cartridge 7 is placed at the predetermined image formation position K (FIG. 3A) relative to the mounting portion 103 (mounted state). More particularly, the boss 7*e* is supported by the supporting portion 17*b*2 of the groove portion 17*b*, and is abutted to the abutting portion (end surface) 17*a*1 of the groove portion 17*b*. The second guide portion 17B positions the boss 7*e* which is disposed upstream of the boss 7*d* at one and the other end portions of the cartridge 7 with respect to the mounting direction.

When the cartridge 7 receives a rotational force for rotating the drum 1 (developing roller 4*a*) from the main assembly 100A, the boss 7*e* is brought into contact to the inner surface of the groove 17*b*, by which the cartridge 7 is prevented from rotating about the bosses 7*d*.

The second guide portion 17B is provided with the opening 17*b*4, groove portion 17*b*3, groove portion 17*b* (abutting portion 17*b*1, supporting portion 17*b*2). The second guide portion 17B guides the boss 7*e* upwardly, and position the boss 7*e* relative to the main assembly 100A when the user pushes the cartridge 7. Thus, the rotation of the cartridge 7 when the cartridge 7 receives the rotational force for rotating the drum 1 (developing roller 4*a*) is limited.

T the first guide portion 17A and the second guide portion 17B are integral with the guide 17. The first guide portion 17A is disposed downstream of the second guide portion 17B with respect to the inserting direction X1.

The abutment state is maintained by the urging force of the spring 17*c*. The boss 7*e* is received by the groove portion 17*b*. At this time, the boss 7*e* is supported by the supporting portion 17*b*2 in a rough state, that is, in the state that it is spaced from the abutting portion 17*b*1 (FIG. 3A, (b)). In other words, in the positioning relative to the main assembly 100A, the preference is on the boss 7*d* to the boss 7*e*. In addition, the rotation of the cartridge 7 about the boss 7*d* when the cartridge 7 receives the rotational force from the main assembly 100A is prevented by the boss 7*e* abutting the inner surface of the groove portion 17*b*.

In this manner, the rotation of the cartridge 7 is prevented. As described hereinbefore, the guide 17 causes the cartridge 7 to be mounted to the mounting portion 103, away from the light blocking plate 11 upwardly.

By doing so, the mounting attitude of the cartridge 7 is stable. In the state that the cartridge 7 is mounted, the transfer roller 5 is elastically abutted to the surface of the drum 1 exposed through the opening 7*c* of the frame 7*a* to form the transfer nip T. Then, the user moves the hand off the grip 7*b* and closes the door 102. By an interrelating mechanism (unshown) interrelated with the door 102, a connected state is established between the drive input portion (unshown) of the mounted cartridge 7 and a drive output portion (unshown) of the main assembly, and a connected state is established between the bias input portion (unshown) and a bias output portion (unshown) of the main assembly. In this state, the apparatus 100 is capable of image forming operation.

As described hereinbefore, the light blocking plate 11 extends from the side having the second opening 9 to below the mounting portion 103 (drum 1). The light blocking plate 11 is provided in a side having the opening 9 with a descending inclined surface 11*a*1 inclining relative to the horizontal direction. In addition, the light blocking plate 11 is provided in a side having the mounting portion 103 with the ascending inclined surface 11*a*3 (11*a*2) which ascends relative to the horizontal direction below the mounting portion 103. In this embodiment, the ascending inclined surfaces 11*a*2, 11*a*3 are provided, but they are not inevitable. Alternatively, the ascending surface may be constituted by a single ascending surface, or a plurality of ascending surfaces.

According to this embodiment, the side having the opening 9 is provided with a descending inclined surface 11*a*1, and therefore, a larger space is provided for the mounting and demounting operation of the cartridge 7 relative to the main assembly 100A. In addition, according to the present invention, the side having the mounting portion 103 is provided with the ascending inclined surface 11*a*3, and therefore, the impingement of external light onto the drum 1 can be efficiently suppressed. In addition, only by inserting the cartridge 7, the cartridge 7 can be guided along the guide 17 to the mounting portion 103

As described hereinbefore, the guide (main assembly side guide) 17 provided in the main assembly 100A includes the guide (first main assembly side guide) 17 provided at one longitudinal end portion of the mounting portion 103 and the guide (second main assembly side guide) 17 provided at the other longitudinal end portion of the mounting portion 103 The second main assembly side guide is omitted in the Figures for the sake of simplicity.

The first main assembly side guide 17 and the second main assembly side guide (unshown) are provided with guide groove portions (first guide portion) 17*a*3 provided at a downstream position with respect to the mounting direction X1 of the cartridge 7. The first main assembly side guide 17 and the second main assembly side guide (unshown) are provided with guide groove portions (second guide portion) 17*b*3 disposed upstream of the guide groove portion 17*a*3 with respect to the mounting direction X1

When the cartridge 7 moves along the ascending inclined surfaces 11*a*2, 11*a*3, the guide groove portion 17*a*3 upwardly guides the first positioning boss (first cartridge side portion-to-be-positioned) 7*d* provided at each of one and the other longitudinal ends of the cartridge 7. The guide groove portion 17*b*3 upwardly guides the second positioning boss (second cartridge side portion-to-be-positioned) 7*e* provided upstream of the boss 7*d* with respect to mounting direction X1, at one and the other longitudinal ends. The guide 17 mounts the cartridge 7 to the mounting portion 103 in the state that it is above and spaced from the light blocking plate 11

Therefore, the cartridge 7 does not contact the light blocking plate 11 in the state that the cartridge 7 is mounted to the mounting portion 103. Therefore, the cartridge 7 does not interfere with the light blocking plate 11 in the state that it is mounted to the mounting portion 103. For this reason, the cartridge 7 can be positioned with high accuracy to the mounting portion 103. As described hereinbefore, when the cartridge 7 moves along the ascending inclined surfaces 11*a*1, 11*a*2, the first guiding portion 17A upwardly guides the boss 7*d* of the cartridge 7, and mounts the cartridge 7 to the mounting portion 103 in the state that the cartridge 7 is away from the light blocking plate 11.

The second guide portion 17B guides the boss 17*e* upwardly and mounts the cartridge 7 in the state that the cartridge 7 is above and spaced from the light blocking plate 11. When the cartridge 7 is taken out of the mounting portion 103, the opposite steps are carried out. By the user pulling the cartridge 7 out, the cartridge 7 moves toward the front side while lowering along the guide portions 17A, 17. The cartridge 7 is guided toward the front side while being supported by the light blocking plate 11 and is removed from the main assembly 100A.

According to this embodiment, the mounting operation of cartridge 7 to the mounting portion can be improved despite the fact that the light blocking plate 11 is utilized for the guide, too. In addition, the dismounting operation of the cartridge 7 from the mounting portion 103 can be improved. According to this embodiment, the positioning accuracy of the cartridge 7 relative to the mounting portion 103 is improved despite the fact that the light blocking plate 11 is utilized for the guide, too.

3. Light Blocking Plate:

In the embodiment, the opening 9 for permitting the introduction of the sheet S to the tray 8 and the tray 10 is not provided a door for closing the opening. Instead, the embodiment utilizes the tray 8 as the openable member as described hereinbefore. This is done, in this embodiment, particularly taking into account the fact that the opening 9 is usually kept open to make the loading operation easy.

When the apparatus 100 is packaged, or when the apparatus 100 is not used for long term, the tray 8 is folded to close the opening 9. By doing so, a projection region from the main assembly 100A is not provided by the tray 8. Therefore, in this embodiment, the opening 9 is normally kept open. Then, there is a liability that external disturbance light L (arrow in (a) of FIG. 4) enters the apparatus 100 through the opening 9. The external disturbance light L might be reflected by the internal member in the apparatus 100 with the result of impinging on the drum 1 as indicated by the arrow L in (b) of FIG. 4. In this embodiment, the light blocking plate 11 is provided to suppress the external disturbance light L reaching the drum 1.

In this embodiment, the light blocking plate 11 is provided above the manual feeding tray 10. The light blocking plate 11 extends from the front side to the rear side, more particularly from a neighborhood of upper end of the opening 9 below the mounting portion 103. In the rear side, it is below the drum 1. The front side of the light blocking plate 1 is preferably above the upper end of the opening 9*a*, since then the amount of the light entering toward the cartridge 7 can be prevented effectively. The light blocking plate 11 extends in the widthwise direction as far as the inner width of the main assembly 100A.

More particularly, one end, with respect to the widthwise direction, of the light blocking plate 11 is fixed to the frame 50L, and the other end is fixed to the frame 50R. The material of the light blocking plate 11 is a mold material such as ABS, PC+ABS or the like, or a metal plate member such as Si coated steel plate. Or, it may be a rigid plastic resin material or the like exhibiting a light blocking property.

Here, ABS is an acrylonitrile-butadiene-styrene, and PC is polycarbonate. The material of the light blocking plate 11 may be any if it can perform the function of blocking light and has strength enough to support and guide the cartridge 7. The light blocking plate 11 functions to block at least a part of the external disturbance light L having entered the main assembly 100A through the opening 9 to prevent it from reaching the drum 1.

That is, the light blocking plate 11 is effective to reduce the external disturbance light L impinging on the drum 1. In this manner, the deterioration of the image quality attributable to the external disturbance light L is prevented. This is 窃 because the impinging light may change the potential of the latent image with the result that an unwanted developer is deposited on the image area or therearound, which leads to the deterioration of the image quality.

With this structure described above, the light blocking plate 11 is effective to block the external disturbance light L and to guide the cartridge 7 upon mounting and demounting it relative to the main assembly. By doing so, the guide 17 provided to guide the cartridge 7 can be downsized and simplified, by which the product cost can be reduced.

Embodiment 2

FIG. 5A is an illustration of the apparatus 100 according to Embodiment 2 of the present invention. The apparatus of this embodiment is similar to that of Embodiment 1 (apparatus 100), but the light blocking plate 11 is provided with a guiding rail (guide portion) 11L at one end of the light blocking plate 11 with respect to a perpendicular to the inserting direction X1 of the cartridge 7, and is provided with a guiding rail (guide portion) 11R at the other end. The rails 11L, 11R are extended in the inserting direction X1. The rails 11L, 11R function to guide the bosses 7*d*, 7*e* when the cartridge 7 is mounted to the mounting portion 103 and when the cartridge 7 is dismounted from the mounting portion 103.

In other words, at one and the other ends of the light blocking plate 11 (with respect to the widthwise direction, that is, left-light direction), the guiding rails (regulating portion) 11L, 11R are integrally provided folded upwardly. The rails 11L and 11R extend from the opening 101 side to the position of the guide 17 and are symmetrical right and left. When the cartridge 7 is mounted to and demounted from the mounting portion 103, the bosses (projections) 7*d*, 7*e* provided at one and the other end portions of the cartridge 7 is placed on the rail 11L and 11R, respectively. By doing so, the lower surface 7*f* of the cartridge 7 can be raised from the upper surface 11*a* of the light blocking plate 11.

In this state, the bosses 7*d*, 7*e* are slid on the rails 11L, 11R when the cartridge 7 is moved. Therefore, the cartridge 7 can be mounted and demounted relative to the main assembly 100, without the lower surface 7*f* contacting the upper surface 11*a*. The structures of this embodiment are similar to the apparatus 100 of Embodiment 1 except for the above-described rails 11L and 11R. Therefore, detailed description is omitted for the sake of simplicity. According to this embodiment, the advantageous effects of the apparatus 100 of Embodiment 1 can be provided similarly. In addition, when the cartridge 7 is mounted to and demounted from the main assembly, it can be avoided that the drum 1 contacts directly to the light blocking plate 11 or the like.

Embodiment 3

In Embodiment 3 of the present invention, the light blocking plate 11 is rotatable relative to the main assembly 100A. FIG. 5B is an illustration of the apparatus 100 of this embodiment. In this embodiment, the light blocking plate (light blocking member) 11 comprises a rear side portion 11-1 and a front side portion 11-2 (two parts) with respect to the inserting direction X1 of the cartridge 7. The rear side portion 11-1 are stationarily provided between the left and right side frames 50L and 50R of the main assembly 100A. The rear side portion 11-1 is called fixed light blocking plate (fixed light blocking member).

The fixed light blocking plate portion 11-1 provides ascending surfaces 11*a*2, 11*a*3. In a connecting portion relative to the fixed light blocking plate 11-1, the front side portion 11-2 is rotatable up and down between the side frames 50L and 50R about a shaft 11*c* provided between the side frames 50L and 50R. The front side portion 11-2 is called rotatable light blocking plate (rotatable light blocking member).

The rotatable light blocking plate 11-2 provide a descending surface 11*a*1. The light blocking plate 11-1 and the light blocking plate 11-2 function to block at least a part of the external disturbance light a having entered the main assembly 100A through the opening 9 to prevent it from impinging on the drum 1. That is, the external disturbance light L impinging on the drum 1 is reduced.

The light blocking plate 11-2 rotates about the shaft 11*c* in interrelation with the opening and closing operations of the door 102. This will be described. The front sides of the inner surfaces of the frames 50L, 50R of the main assembly 100A are provided with light blocking plate cam plates 25 which are the same in configuration and symmetrical left and right and which are slidable up and down. The cam plates 25 is provided with an elongated hole 25*a* with which an end portion of a horizontal shaft 11*d* provided at the front side of the light blocking plate 11-2 is engaged. In this manner, the light blocking plate 11-2 and the cam 25 are connected with each other by the horizontal shaft 11*d* and the elongated hole 25*a*.

Therefore, up and down movement of the cam 25 rotates the light blocking plate 11-2 up and down about the shaft 11*c*. To the front side, an outer casing cam 26 is fixed. When the door 102 is rotated relative to the main assembly 100A about the shaft 102*a* to open or close, the cam plate 26 rotates about the shaft 102*a* integrally with the door 102. The cam 26 is provided at each of one and the other ends of the main assembly 100A, and the cams 26 are the same in configuration and are symmetrical left and right. The cams 26 correspond to cams 25, respectively. The cam 25 moves up and down in interrelation with rotation of the cam 26.

As shown in FIG. 5B, in the state that the door 102 is kept in the close position A so that the opening 101 is closed, the cam 25 is raised by the bulged portion of the cam 26 and takes an upper position. By this, the light blocking plate 11-2 is rotated about the shaft 11*c* toward the mounting portion 103 and is maintained at an upper position.

In other words, the position of the blocking plate 11-2 is determined in the state that it is inclined relative to the manual insertion tray 10 therebelow (the light blocking plate 11-2 is retracted from the tray 10). In this state, the space between the tray 10 and the light blocking plate 11-2, that is, the operation space for permitting sheet supplying into the sheet tray 10 can be assured to be large. In this manner, the supplying operativity in supplying the sheets S into the tray 10 is improved.

FIG. 6A shows by broken lines a midstream state toward the open position of the door 102 and shows by solid lines the state that the door 102 is the open position B. With the opening rotation of the door 102, the cam 26 rotates. In interrelation therewith, the cam 25 moves down. With this movement, the rotatable light blocking plate 11-2 rotates down about the shaft 11*c*. In the state that the door 102 is in the open position B, the cam 26 is away from the cam 25. In this state, the cam 25 is lowered to the position where the bottom end portion thereof is abutted to a receiving portion 8*b* provided in the main assembly 100A and is kept there.

Thus, the position of the light blocking plate 11-2 is determined in the state that it is substantially in parallel with the tray 10 therebelow. By the light blocking plate 11-2 lowering in this state, the movement space usable for mounting the cartridge 7 to the mounting position 103 can be relatively large. That is, the large operation space for the mounting and demounting of the cartridge 7 can be assured. The mounting and demounting operation of the cartridge 7 relative to the main assembly 100A is carried out through the opening 101 similarly to Embodiment 1 in the state that the door 102 is opened as shown in FIG. 6B (front access).

When the cartridge 7 is inserted into the main assembly 100A, the guiding is effected by the guide 17 adjacent the positioning place and is effected by the light blocking plates 11-2 and 11-1 otherwise, similarly to Embodiment 1. As shown in FIG. 6A, the door 102 in the open position is moved toward the closing position relative to the opening 101, by which the cam 26 moves the cam 25 upwardly in interrelation with the closing rotation of the door 102. By this, the light blocking plate 11-2 rotates upwardly about the shaft 11*c*. Then, by sufficiently closing the door 102, the light blocking plate 11-2 is maintained at the upper rotated position shown in FIG. 5B.

In the description of this embodiment, the same reference numerals as in Embodiments 1 and 2 are assigned to the elements having the corresponding functions in this embodiment, and the detailed description thereof is omitted for simplicity. According to this embodiment, as shown in FIG. 5B, in the state that the door 102 is in the closing position, the light blocking plate 11-2 is in the position retracted away relative to the tray 10 (upper position). As shown in FIG. 6B, in the state that the door 102 is in the open position, the light blocking plate 11-2 is in the lower position.

Thus, the apparatus can be downsized while assuring sufficiency of the operation region when the user moves the width regulating plate 10*a*, the operation region in the feeding portion when jam clearance operation is carried out adjacent the feeding portion, and the gap between the light blocking plate 11 and the scanner 3 for the mounting and demounting of the cartridge 7.

Embodiment 4

Part (a) of FIG. 7 is an illustration of an apparatus 100 according to Embodiment 4 of the present invention. Similarly to the apparatus 100 of Embodiment 3, in the apparatus 100 of this embodiment, the light blocking plate 11 is constituted by two parts, namely the fixed light blocking plate 11-1 and the rotatable light blocking plate 11-2. In this embodiment, the light blocking plate 11-2 is raised to the upper part position only by elastic force of a push-up spring (elastic member) 28 without interrelation with the rotation of the door 102.

The light blocking plate 11-2, in a free state, is raised by the elastic force of the spring 28 and is kept in the upper position thereby. By this, the light blocking plate 11-2 is rotated about the shaft 11*c* toward the mounting portion 103 and kept there. The position of the light blocking plate 11-2 is determined in the state that it is inclined relative to the tray 10 below the light blocking plate 11-2 is retracted from the tray 10). In this state, a relatively large operation space, that is, a large space between the tray 10 and the light blocking plate 11-2 can be assured for supplying the sheets S into the tray 10.

When the cartridge 7 is mounted and dismounted relative to the main assembly 100A, the light blocking plate 11-2 is manually raised against the elastic force of the spring 28 after the user opens the door 102. Or, the light blocking plate 11-2 is lowered against the elastic force of the spring 28 by the weight of the cartridge 7. The light blocking plate 11-2 can be pushed down until it is stopped by a stopper pin 29. In the description of this embodiment, the same reference numerals as in Embodiments 1-3 are assigned to the elements having the corresponding functions in this embodiment, and the detailed description thereof is omitted for simplicity.

Embodiment 5

Part (b) of FIG. 7 is an illustration of a major part of the apparatus 100 according to Embodiment 5 of the present invention. In this embodiment, the cartridge 7 is inserted into the mounting portion 103 in interrelation with rotation of the light blocking plate 11. In this embodiment, the light blocking plate 11 is rotatable up and down between the frames 50L, 50R about the shaft 11*c* provided between the frames 50L, 50R in the rear side. The rotation of the light blocking plate 11 may be effected in interrelation with the opening and closing operation of the door 102 as described with respect to Embodiment 3, or it may be effected by spring 28 and manually as described with respect to Embodiment 4.

Normally, when the user mounts the cartridge 7 to the mounting portion 103, the user pushes the cartridge 7 to the image formation position K and sets it in the mount position. The set position is the position where the dowel 7*d* is engaged with the engagement, and the dowel 7*e* is engaged with the groove 17*b*. With the structure of the embodiment, even when the cartridge 7 is not inserted to the image formation position K where the transfer roller 5 is contacted to the drum 1 ((b) of FIG. 7), the cartridge 7 can be automatically pushed.

More particularly, by the upward rotation force of the light blocking plate 11, the surface 11*d* of the light blocking plate 11 is contacted to the surface 7*h* of the cartridge 7, by which the cartridge 7 is pushed in the inserting direction X1. By this, the cartridge 7 is guided to the image formation position K.

With this structure, even when the cartridge 7 is not sufficiently pushed into the mounting portion 103, the cartridge 7 can be automatically pushed to a sufficient extent in interrelation with the rotation of the light blocking plate 11. Therefore, the usability when the cartridge 7 is inserted can be improved. As the structure for pushing the cartridge 7, the door 102 is provided with a projection or the like (unshown). When the door 102 rotates, the projection or the like abuts to the cartridge 7.

By this, the cartridge 7 can be pushed further. However, in this embodiment, the distance between the position of the light blocking plate 11 and the image formation position K is quite small. Therefore, according to this embodiment, the pushing structure can be downsized and simplified as compared with the above-described case in which the door 102 is provided with a projection. In the description of this embodiment, the same reference numerals as in Embodiments 1-4 are assigned to the elements having the corresponding functions in this embodiment, and the detailed description thereof is omitted for simplicity.

Embodiment 6

FIG. 8A and (a) of FIG. 9 are illustrations of the major parts of the apparatus according to Embodiment 6 of the present invention. In this embodiment, the door 102 functions as a guide when the cartridge 7 is moved into and out of the main assembly 100A. The apparatus 100 of this embodiment is similar to the apparatus 100 of Embodiment 1, the position of the center shaft 102*a* about which the door 102 rotates for opening and closing the door is at the same level as the front side end of the light blocking plate 11. The door 102 rotates about the shaft 102*a* relative to the main assembly 100A.

The door 102 is rotated about the shaft 102*a* upwardly to the close position A closing of the opening 101 (FIG. 8A). The closed door 102 is maintained in the state that it is locked with the main assembly of the apparatus 101 by a hook member (unshown). In addition, when the hook member is released, the door 102 can be moved frontwardly to the open position B where the door 102 is substantially horizontally and the door 102 is open (FIG. 8B).

By this, the opening 101 is widely opened. The opening state of the door 102 is stably maintained by a stopper member (unshown). The upper surface (inner surface of the door) 102*b*, when the door 102 is open, is substantially flush with the upper surface 11*a* of the light blocking plate 11. The opening 9 is open in the front side of the main assembly 100A below the shaft 102*a*.

The mounting and demounting operation of mounting and demounting the cartridge 7 to the mounting portion 103 is carried out through the opening 101 when the door 102 is in the open position (FIG. 8B). This is the same as with Embodiment 1. In such a case, in this embodiment, the upper surface 102*b* of the door 102 opened to the open position B functions as a guide together with the upper surface 11*a* of the light blocking plate 11 when the cartridge 7 is inserted into and removed from the main assembly 100A. The insertion track of the cartridge 7 is such that the lower surface 7*f* of the cartridge 7 moves into the main assembly 100A first along the upper surface 102*b* of the door 102.

Then, similarly to Embodiment 1, it is guided by the upper surface 11*a* of the light blocking plate 11. The guiding upon inserting the cartridge 7, is effected by the guide 17 in the neighborhood of the mounting portion 103 (set position), and is effected by the upper surface 102*b* of the opened door 102 and the upper surface 11*a* of the light blocking plate 11 in the other positions, similarly to Embodiment 1. The structures for guiding the cartridge 7 to the mounting portion 103 by the guide 17 and the structures for positioning the cartridge in the mounting portion 103 are similar to those of Embodiment 1. The track for removing the cartridge 7 is opposite the track for inserting it.

As shown in (a) of FIG. 9, the cartridge 7 is provided with an inclined surface (portion-to-be-guided) 7*h*, and the door 102 is provided with an inclined surface (guide portion) 102*c*. By this, when the cartridge 7 is mounted or dismounted, the cartridge 7 can smoothly ride over from the door 102 to the light blocking plate 11 or from the light blocking plate 11 to the door 102.

According to this embodiment, when the cartridge 7 is inserted, the cartridge 7 can be guided from the door 102. Therefore, it is not necessary to align the cartridge 7 with the opening 101 when it is inserted, as contrasted to the conventional system. Accordingly, the usability in the insertion of the cartridge can be improved. In this embodiment, it may be that a part of the light blocking plate 11 is moved interrelatedly with the door 102 to rotate, similarly to Embodiment 3, and then the same advantageous effect as with Embodiment 3 can be provided.

Embodiment 7

Part (b) of FIG. 9, FIGS. 10A and 10B illustrate the apparatus 100 according to Embodiment 7 of the present invention. In the apparatus 100 of Embodiment 6, the cartridge 7 is a so-called integral type process cartridge. However, in this embodiment, the cartridge mountable to the main assembly 100A may be a so-called separable type. More particularly, it may be a developing cartridge or a drum cartridge. Therefore, when the developing cartridge is used, the drum 1 may be provided in the main assembly 100A.

In this embodiment, the drum 1 is provided in the main assembly 100A. An image is formed on the sheet S in the state that the developing cartridge 7A is dismountably mounted to the mounting portion 103. In the description of this embodiment, the same reference numerals as in Embodiment 1 are assigned to the elements having the corresponding functions in this embodiment, and the detailed description thereof is omitted for simplicity.

Cartridge 7A is a developing means for developing an electrostatic latent image formed on the drum 1 with a powdery developer. The cartridge 7A comprises a developing roller (developing member) 4*a* for developing the electrostatic latent image formed on the drum 1 with the developer, and a developer accommodating portion 4*b* accommodating the developer. The cartridge 7A is demountably mounted to the mounting portion 103. In the state that the cartridge is set in the mounting portion 103 in place, the developing roller 4*a* or spacer rollers (unshown) are contacted to the drum 1. By this, the electrostatic latent image formed on drum 1 can be developed. The drum 1 is provided in the main assembly 100A.

Therefore, in the cartridge 7A, the image formation position K is a position where the electrostatic latent image formed on the drum 1 can be developed (position shown in FIGS. 10A and 10B). In this embodiment, when the cartridge 7A set in the image formation position K, the developing roller 4*a* or the spacer roller (unshown) are contacted to the drum 1. The cartridge 7A is provided one and the other longitudinal ends of the frame 7*a* with bosses 7*d*, 7*e*, respectively, similarly to the cartridge 7 of Embodiment 1.

In addition, there is provided a grip 7*b* to be gripped by the user. The inner surfaces of the frames 50L, 17R are provided with respective cartridge guides (main assembly side guide portions) 17 which are symmetrical left and right. The structures of the guide 17 are substantially the same as those of the guide 17 described in conjunction with (b) of FIG. 7 (Embodiment 5).

The structures for mounting and dismounting the cartridge 7A relative to the main assembly 100A and for positioning the cartridge 7A in the mounting portion 103 are similar to those of Embodiment 1. More particularly, the cartridge 7A is inserted through the opening 101 (FIGS. 10A and 10B). The cartridge 7A is guided by the lower surface 7*f* of the frame 7*a* and the upper surface 11*a* of the light blocking plate 11. In the neighborhood of the mounting portion 103, the bosses 7*d*, 7*e* are guided by the guide 17. After the mounting, the boss 7*d* is urged to the end surface 17*d* of the groove portion 17*a* of the guide 17 by the elastic force (urging force) of the spring (elastic member) 17*c*.

By this, the cartridge 7A is set in place in the mounting portion 103. In this state, the developing roller 4*a* or the spacer roller (unshown) is contacted to the drum 1. By this, the electrostatic latent image formed on drum 1 can be developed.

According to this embodiment, a part of the guide portions 17A, 17B is common. More particularly, the bosses 7*d*, 7*e* enter the grooves 17*a*3, 17*b*3 through the common openings 17*a*4, and 17*b*4. The bosses 7*d*, 7*e* move upwardly while being guided by the grooves 17*a*3, 17*b*3. And, the cartridge 7A is positioned to the mounting portion 103 in the state that the boss 7*d* abuts the abutment portion 17*a*1.

In this state, the cartridge 7A is above the light blocking plate 11. In the dismounting of the cartridge 7A from the main assembly 100A, the process is reverse. According to this embodiment, the boss 7*d* is coaxial with the axis of the developing roller 4*a*.

Also in this embodiment, the similar advantageous effects as with the above-described embodiments are provided.

Parts (a) and (b) of FIG. 11 show sizes in the apparatus 100 of Embodiment 1. In (a) of FIG. 11, L1 is a length of the descending surface 11*a*1 and is approx. 100 mm; L2 is a length of the ascending surface 11*a*2 and is approx. 30 mm; and L3 is a length of the ascending surface 11*a*2 and is approx. 40 mm. In addition, θ1 is a descending angle relative to the horizontal surface of the descending surface 11*a*1 and is approx. 10 degree; θ2 is an ascending angle relative to the horizontal surface of the ascending surface 11*a*2 and is approx. 7 degree; θ3 is an ascending angle relative to the horizontal surface of the ascending surface 11*a*3 and is approx. 40 degree.

The width of the light blocking plate 11 is approx. 280 mm, and is substantially the same as the width of the opening 101. In (b) of FIG. 11, L4 is a width of the opening 101 and is approx. 280 mm, and L5 is a height of the opening 101 and is approx. 75 mm. In addition, L6 is a height of the opening 9 and is approx. 60 mm. However, those sizes are examples and not restrictive in the present invention.

In the foregoing embodiments of the present invention, the external light is substantially prevented from impinging on the drum 1 by the tray 8 and the light blocking plate 11. However, it is an alternative within the present invention that the arrangement of the light blocking plate 11 is selected so that the external light is substantially prevented from impinging on the drum 1 without using the tray 8.

According to the foregoing embodiments, the means for guiding the cartridge 7 (7A) in the predetermined direction into the main assembly 100A can perform the function of substantially preventing the external light having entered the main assembly 100A from impinging on the photosensitive drum 1.

In addition, according to the foregoing embodiments, the light blocking plate (light blocking member) 11 for substantially preventing the external light having entered the main assembly 100A from impinging on the photosensitive drum 1 functions also as the guide means for guiding the cartridge 7 (7A) in the predetermined direction into the main assembly 100A These advantageous effects are contributable to downsize the apparatus. In addition, according to the foregoing embodiments, the external light entering the main assembly 100A can be suppressed.

1.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 212045/2010 filed Sep. 22, 2010 which is hereby incorporated by reference.

What is claimed is:

1. An electrophotographic image forming apparatus for forming an image on a recording material in a state that a cartridge is mounted to a mounting portion of a main assembly of said apparatus, said apparatus comprising:

an opening provided in said main assembly for permitting said cartridge to pass into said main assembly to mount said cartridge to said mounting portion;

an openable member provided in said main assembly and movable between a closed position for closing said opening and an open position for opening said opening;

an exposure device for emitting light to which an electrophotographic photosensitive member provided in said cartridge is exposed; and a guiding member provided in said main assembly to guide said cartridge, wherein said guiding member functions to guide said cartridge toward said mounting portion when said cartridge is mounted to said mounting portion through said opening that is open by movement of said openable member to the open position, wherein said guiding member includes (i) a descending surface that descends relative to a horizontal direction, and (ii) an ascending surface that ascends relative to the horizontal direction and which is disposed below said mounting portion, and wherein, when said cartridge is mounted to said mounting portion, said cartridge is moved down along said descending surface below said exposure device and then is moved up along said ascending surface in a portion downstream of said exposure device with respect to the mounting direction.

2. An apparatus according to claim 1, further comprising:

a first main assembly side guide provided adjacent one longitudinal end of said mounting portion in said main assembly; and a second main assembly side guide provided adjacent the other longitudinal end of said mounting portion in said main assembly, wherein each of said first main assembly side guide and said second main assembly side guide includes a first guide portion provided in a relatively downstream position with respect to a mounting direction of said cartridge and a second guide portion provided in a relatively upstream position, and wherein, when said cartridge moves along said ascending surface, said first guide portions upwardly guide first cartridge side portions-to-be-positioned provided adjacent to one and the other ends of said cartridge, respectively, said second guide portions upwardly guide second cartridge side portions-to-be-positioned provided adjacent to said one and the other ends of said cartridge upstream of said first cartridge side portions-to-be-positioned, respectively, and said cartridge is mounted to said mounting portion in a state that said cartridge is spaced from said guiding member.

3. An apparatus according to claim 1, further comprising:

a first main assembly side guide provided adjacent one longitudinal end of said mounting portion in said main assembly; and a second main assembly side guide provided adjacent the other longitudinal end of said mounting portion in said main assembly, wherein each of said first main assembly side guide and said second main assembly side guide includes a first guide portion provided in a relatively downstream position with respect to a mounting direction of said cartridge and a second guide portion provided in a relatively upstream position, said first guide portions positioning first cartridge side portions-to-be-positioned provided adjacent to said one and the other ends, respectively, and said second guide portions positioning second cartridge side portions-to-be-positioned provided adjacent to said one and the other ends upstream of said first cartridge side portions-to-be-positioned, respectively.

4. An apparatus according to claim 2 or 3, wherein said first cartridge side portions-to-be-positioned is disposed coaxially with an axis of said electrophotographic photosensitive drum provided in said cartridge or is disposed coaxially with an axis of a developing roller provided in said cartridge.

5. An apparatus according to claim 1, wherein said cartridge is provided with a projection adjacent to each of one and the other longitudinal end thereof, and said guiding member is provided at each of said one and the other longitudinal end with a regulating portion for regulating a moving direction of said projection.

6. An apparatus according to claim 5, wherein said projections function as a first cartridge side portion-to-be-positioned and a second cartridge side portion-to-be-positioned adjacent to said one and the other longitudinal ends, respectively, and wherein said first cartridge side portion-to-be-positioned is disposed coaxially with said electrophotographic photosensitive drum and is positioned relative to said main assembly in a state that said cartridge is mounted to said mounting portion, and said second cartridge side portion-to-be-positioned limits rotation of said cartridge, about said first cartridge side portion-to-be-positioned, which is otherwise caused by a rotational force received from said main assembly by abutting said main assembly.

7. An apparatus according to claim 1, wherein said guiding member is rotatable relative to said main assembly.

8. An apparatus according to claim 7, wherein said cartridge is inserted to said mounting portion in interrelation with rotation of said guiding member.

9. An apparatus according to claim 7, wherein said guiding member rotates in interrelation with rotation of said openable member.

10. An apparatus according to claim 1, wherein said openable member guides, when it is in its open position, said cartridge when said cartridge is mounted to said mounting portion.

11. An apparatus according to claim 1, wherein said opening is a first opening, wherein said apparatus further comprises a second opening provided in said main assembly for permitting the recording material to pass into said main assembly to supply the recording material, and wherein said guiding member is provided between said first opening and said second opening.

12. An apparatus according to claim 11, wherein said guiding member is a light blocking member to suppress impingement of at least a part of external light, having entered said main assembly through said second opening, onto said electrophotographic photosensitive drum.

* * * * *